US007139501B2

(12) United States Patent
Takami et al.

(10) Patent No.: US 7,139,501 B2
(45) Date of Patent: Nov. 21, 2006

(54) CHARGE VOLTAGE CONTROL CIRCUIT AND IMAGE FORMING APPARATUS WHICH CONTROLS A CHARGE VOLTAGE BASED ON A DISCHARGE CURRENT

(75) Inventors: Hiroshi Takami, Kanagawa (JP); Hiroaki Sakai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 10/985,931

(22) Filed: Nov. 12, 2004

(65) Prior Publication Data

US 2005/0111869 A1 May 26, 2005

(30) Foreign Application Priority Data

Nov. 20, 2003 (JP) ..... 2003-390753
Nov. 20, 2003 (JP) ..... 2003-390754

(51) Int. Cl.
*G03G 15/00* (2006.01)

(52) U.S. Cl. ..... 399/89

(58) Field of Classification Search ..... None
See application file for complete search history.

(56) References Cited

U.S. PATENT DOCUMENTS 4,851,960 A 7/1989 Nakamura et al. ..... 361/225
6,278,103 B1 8/2001 Takami ..... 250/214 R
6,539,184 B1 3/2003 Shimura et al. ..... 399/50
6,564,023 B1 5/2003 Takami et al. ..... 399/50
2004/0005159 A1 1/2004 Ito et al. ..... 399/50

FOREIGN PATENT DOCUMENTS

JP 63-149668 6/1988

*Primary Examiner*—Quana Grainger
(74) *Attorney, Agent, or Firm*—Fitzpatrick, Cella, Harper & Scinto

(57) ABSTRACT

An image forming apparatus includes a control voltage generation circuit which inputs a primary AC voltage to the primary side of a voltage transformer, generates a control voltage corresponding to a current generated on the secondary side of the voltage transformer in accordance with the primary AC voltage, and controls the primary AC voltage on the basis of the control voltage and a control signal, a current detection circuit which is connected, through a capacitor, to a path which supplies the current generated on the secondary side of the voltage transformer to a charge roller and detects a charge current to charge an image carrier, and a control circuit which determines the control signal on the basis of the relationship between a predetermined control signal (PRICNT) and a current value (Icap) detected by the current detection circuit in accordance with the predetermined control signal and controls the primary AC voltage to be generated by the voltage generation circuit.

25 Claims, 22 Drawing Sheets

CHARGE AC VOLTAGE VS. CHARGE AC VOLTAGE CHARACTERISTIC

DETECTION CHARACTERISTIC OF VOLTAGE DETECTION CIRCUIT A

DETECTION CHARACTERISTIC OF VOLTAGE DETECTION CIRCUIT B

CHARGE AC VOLTAGE VS. CHARGE AC VOLTAGE CHARACTERISTIC

DETECTION CHARACTERISTIC OF VOLTAGE DETECTION CIRCUIT A

DETECTION CHARACTERISTIC OF VOLTAGE DETECTION CIRCUIT B

CHARGE VOLTAGE CONTROL CIRCUIT AND IMAGE FORMING APPARATUS WHICH CONTROLS A CHARGE VOLTAGE BASED ON A DISCHARGE CURRENT

FIELD OF THE INVENTION

The present invention relates to an image forming apparatus which electrically charges an image carrier, and a charge voltage control circuit thereof.

BACKGROUND OF THE INVENTION

An electrophotographic image forming apparatus which prints an image by electrophotography has a drum-shaped electrophotographic photosensitive body (to be referred to as a photosensitive drum hereinafter), as is known. In forming an image, the surface of the photosensitive drum is uniformly electrically charged to a predetermined potential. This electric charge processing generally uses charging up with corona discharge, in which a corona generated by applying a high voltage to a thin corona discharge wire is made to act on the photosensitive drum surface to charge it.

However, the recent mainstream is a contact charge system which is advantageous in low-voltage process, low ozone generation amount, and low cost. In this contact charge system, for example, a roller charge member (to be referred to as a charge roller hereinafter) is caused to abut against the surface of a photosensitive drum. A voltage is applied to the charge roller to electrically charge the photosensitive drum. To obtain a desired potential Vd on the photosensitive drum surface by the contact charge system, a DC voltage (Vd+Vth) (discharge start voltage (charge start voltage) to the charged body when a DC voltage is applied to the charge member) is applied to the charge roller.

To make the charge further uniform, as disclosed in Japanese Patent Laid-Open No. 63-149668, an "AC charging method" is used. In this method, a voltage (alternating voltage/undulating voltage/oscillating voltage; a voltage whose value changes periodically over time) obtained by superposing an alternating voltage component (AC voltage component) having a peak-to-peak voltage twice or more Vth on a DC voltage corresponding to the desired potential Vd is applied to a contact charge member. In the AC charge method, an AC voltage is applied to alternately cause discharge to the positive and negative sides so that uniform charge can be attained. For example, an AC voltage (oscillating voltage) obtained by superposing an AC voltage which has a peak-to-peak voltage twice or more the discharge start voltage (charge start voltage) of the charged body upon applying a DC voltage on a DC voltage (DC offset bias) is applied. In this case, the charge roller serving as a charged body can be almost uniformly charged, as is known. Assume that an AC voltage having a sine wave is applied to the charge roller. A resistive load current flowing to the resistive load between the charge roller and the photosensitive drum, a capacitive load current flowing to the capacitive load between the charge roller and the photosensitive drum, and a discharge current between the charge roller and the photosensitive drum flow. A current as the sum of these currents flows to the charge roller. To stably charge the charge roller, the discharge current amount preferably has a predetermined value or more, as is empirically known.

FIG. 21 is a graph showing the characteristic of a charge current (Ic) which flows to the charge roller when a charge AC voltage (Vc) is applied to the charge roller. The voltage Vc is indicated by the peak voltage value of the AC voltage.

The current Ic is indicated by the effective value of the AC current. The peak voltage value of the AC voltage means a voltage value ½ the peak-to-peak voltage of the AC voltage.

Referring to FIG. 21, when the amplitude (peak voltage value) of the charge AC voltage (Vc) is gradually increased, the charge current (Ic) flows accordingly. When the charge AC voltage (Vc) is equal to or lower than a predetermined voltage (Vth), the amplitude of the charge AC voltage is almost proportional to the charge current. The reason is that the resistive load current and capacitive load current are proportional to the voltage amplitude, and no discharge phenomenon occurs, and no discharge current flows because the voltage amplitude (peak voltage value) is small. When the amplitude of the charge AC voltage (Vc) is further increased, the discharge phenomenon starts at the predetermined voltage (Vth). The charge AC voltage and charge current (Ic) are not proportional any more. The charge current (Ic) becomes larger by an amount corresponding to a discharge current (Is). To obtain stable electric charge, a charge voltage (Vt) is set such that the discharge current (Is) has a predetermined value or more.

However, when the discharge current (Is) to the photosensitive drum increases, photosensitive drum degradation such as wear of the photosensitive drum is accelerated. In addition, abnormal images such as image deletion may occur due to discharge products under a high-temperature high-humidity environment. For this reason, to obtain stable charge and solve the above-described problems, a minimum necessary charge AC voltage is applied to minimize discharge which is alternately caused to the positive and negative sides.

In fact, the relationship between the discharge amount and the applied voltage to the photosensitive drum is not always constant. It changes depending on the thickness of the photosensitive layer or dielectric layer of the photosensitive drum, the charge member, or an environmental variation in air. Under a low-temperature low-humidity environment (to be referred to as an L/L environment hereinafter), discharge hardly occurs because the materials dry, and the resistance values increase. To obtain uniform charge, a peak-to-peak voltage having a predetermined value or more is necessary. Under a high-temperature high-humidity environment (H/H), conversely, even when the minimum charge AC voltage to obtain uniform charge in the L/L environment is applied, discharge more than necessary occurs because the materials absorb moisture, and the resistance values decrease. Since the discharge amount increases, problems such as image formation errors, toner fusion, wear of the photosensitive drum by photosensitive drum surface degradation, and short life are posed.

As is known, such a change in discharge amount occurs not only due to the above-described factors by environmental variations but also due to resistance value variations due to manufacturing variations of charge members or contamination, electrostatic capacity variations of the photosensitive drum caused by endurance, and characteristic variations of the high voltage generator in the image forming apparatus main body.

To suppress the change in discharge amount, the "discharge current control system" disclosed in Japanese Patent Laid-Open No. 63-149668 can change the AC voltage to be applied to the charge member. The AC voltage vs. AC current characteristic is detected in each of a voltage range where the peak voltage of the AC voltage is less than the voltage (Vth) at which the discharge phenomenon starts and a voltage range more than the voltage (Vth). An AC voltage value to obtain an optimum discharge amount is calculated from the two detected characteristic lines. Accordingly, the voltage level of the peak voltage of the AC voltage to be applied to the charge member is determined.

Points A, B, C, and D indicated by circles represent sampling points in FIG. 21. Sampling is executed at the points A and B in the voltage range less than the voltage (Vth) at which the discharge phenomenon starts. Accordingly, a characteristic LINE-A of the charge AC voltage (Vc) and charge current (Ic) in the region where no discharge current is generated is measured. Similarly, sampling is executed at the points C and D after discharge. Accordingly, a characteristic LINE-B of the charge AC voltage (Vc) and charge current (Ic) in the region where the discharge current is generated is measured. A charge AC voltage value to obtain a predetermined discharge current value is calculated on the basis of the relationship between the two characteristic lines obtained by the above-described method. The charge AC voltage is controlled in accordance with the value, thereby suppressing the variation in discharge amount.

FIG. 22 depicts a view showing the timing of the above-described sampling at the sample points in an image forming apparatus using the conventional discharge current control method.

When the main power of the apparatus main body is turned on, a pre-multiple rotation step of a fixing roller is executed to perform a series of processing operations of, e.g., driving the fixing device and heating it to a predetermined temperature. Then, a standby state is set. When a print start instruction is received from an external device such as an external personal computer, a pre-rotation step as predetermined print preparation is executed. After that, a print step of executing the print operation on a printing paper sheet by a series of electrophotographic processes starts. In a mode for executing the print operation on a plurality of printing paper sheets, predetermined processing is executed in a paper feed interval step until the print operation for the next printing paper sheet. Then, the print step for the second and subsequent paper sheets starts. When the print step for the last printing paper sheet is ended, a post-rotation step is executed, and the standby state is set again. The above-described sampling at the points A and B, and C and D is executed in the pre-rotation step. After the charge AC voltage level set on the basis of the sampling result, the print step starts. When sampling is executed at timings except the print steps, any errors such as abnormal images generated by the charge voltage equal to or lower than the discharge start voltage (Vth) during sampling can be prevented.

In the conventional discharge current control method, however, when a "continuous print mode" is set to continuously execute print processing for a plurality of printing paper sheets, the value of the discharge current varies during the print operation. This problem is posed when the temperature near the photosensitive drum rises during the print operation in the continuous print mode, and the relationship between the discharge current and the applied voltage to the charge roller changes. More specifically, the characteristic lines LINE-A and LINE-B shown in FIG. 21 vary during the print operation. Even when the charge AC voltage which is set in accordance with the sampling result at the start of printing is applied, the discharge current cannot be controlled to the desired value. To solve this problem, the print operation is stopped at a predetermined interval for a predetermined period in the continuous print mode to decrease the peak voltage of the charge AC voltage to the discharge start voltage (Vth) or less. Then, sampling is executed again, and the charge voltage output to obtain the optimum discharge current is set again. However, this measure is not effective because the print speed of the image forming apparatus decreases.

In the image forming apparatus using the conventional discharge current control method, since the scale of the high voltage circuit which generates the charge AC voltage is large, the following problems rise.

(1) The manufacturing cost of the high voltage circuit is high.

(2) The high voltage circuit is bulky, and consequently, the image forming apparatus becomes bulky.

A charge bias circuit using the conventional discharge current control method superposes a DC bias on the charge AC voltage and outputs it from the output terminal. The output terminal is connected to the charge roller. In the conventional discharge current control method, the discharge current is calculated by detecting the relationship between the AC output voltage and the AC output current. Hence, the charge bias circuit includes a detection circuit which detects the level of the AC output voltage. The AC output voltage detection circuit includes a number of electric components, and many of them generate large potential differences between the terminals. In addition, large potential differences are generated between the terminals of capacitors, diodes, and resistors used in this circuit. For these reason, components of high dielectric breakdown voltage specifications which can stand a large potential difference must be used.

Since such electric components of high dielectric breakdown voltage specifications are generally expensive, the manufacturing cost of the circuit becomes high. In a component which generates a large potential difference, the distance between the terminals must be large to ensure the insulating properties between them. In addition, even the distance between the components must also be large to ensure the insulating properties between them. As a result, the circuit scale becomes large.

SUMMARY OF THE INVENTION

The present invention has been made in consideration of the above-described problems, and has as its features to provide a charge voltage control circuit and an image forming apparatus, in which a charge voltage circuit to execute discharge current control can be made compact at a low cost.

It is another aspect of the present invention to provide a charge voltage control circuit which accurately generates a predetermined discharge amount to obtain uniform charge independently of environmental variations or characteristic variations of the charge member in the manufacture, a control method therefor, and an image forming apparatus.

According to an aspect of the present invention, there is provided with an image forming apparatus which charges an image carrier and transfers an image formed on the image carrier to a recording medium to form an image, comprising: AC voltage generation means for generating an AC voltage; a charge member to which the AC voltage from said AC voltage generation means is applied; current detection means, connected through a capacitive member to a path which supplies a current from said AC voltage generation means to the charge member, for detecting a current value corresponding to the AC voltage flowing to the capacitive member; and control means for determining an AC voltage upon image formation on the basis of a first value which is detected by the current detection means when an AC voltage less than a discharge start voltage in the image carrier is applied to the charge member and a second value which is detected by the current detection means when an AC voltage not less than the discharge start voltage is applied to the charge member.

Other features, objects and advantages of the present invention will be apparent from the following description when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 3A and 3B are block diagrams for explaining the relationship between a capacitor AC current (Icap) and an AC output current (It) from a high voltage transformer according to the first embodiment, in which FIG. 3A shows the relationship when no discharge occurs, and FIG. 3B shows the relationship when discharge has occurred.

DETAILED DESCRIPTION OF THE PREFERRED EMBODIMENTS

The preferred embodiments of the present invention will be described below in detail with reference to the accompanying drawings.

[First Embodiment]

Figure 1:
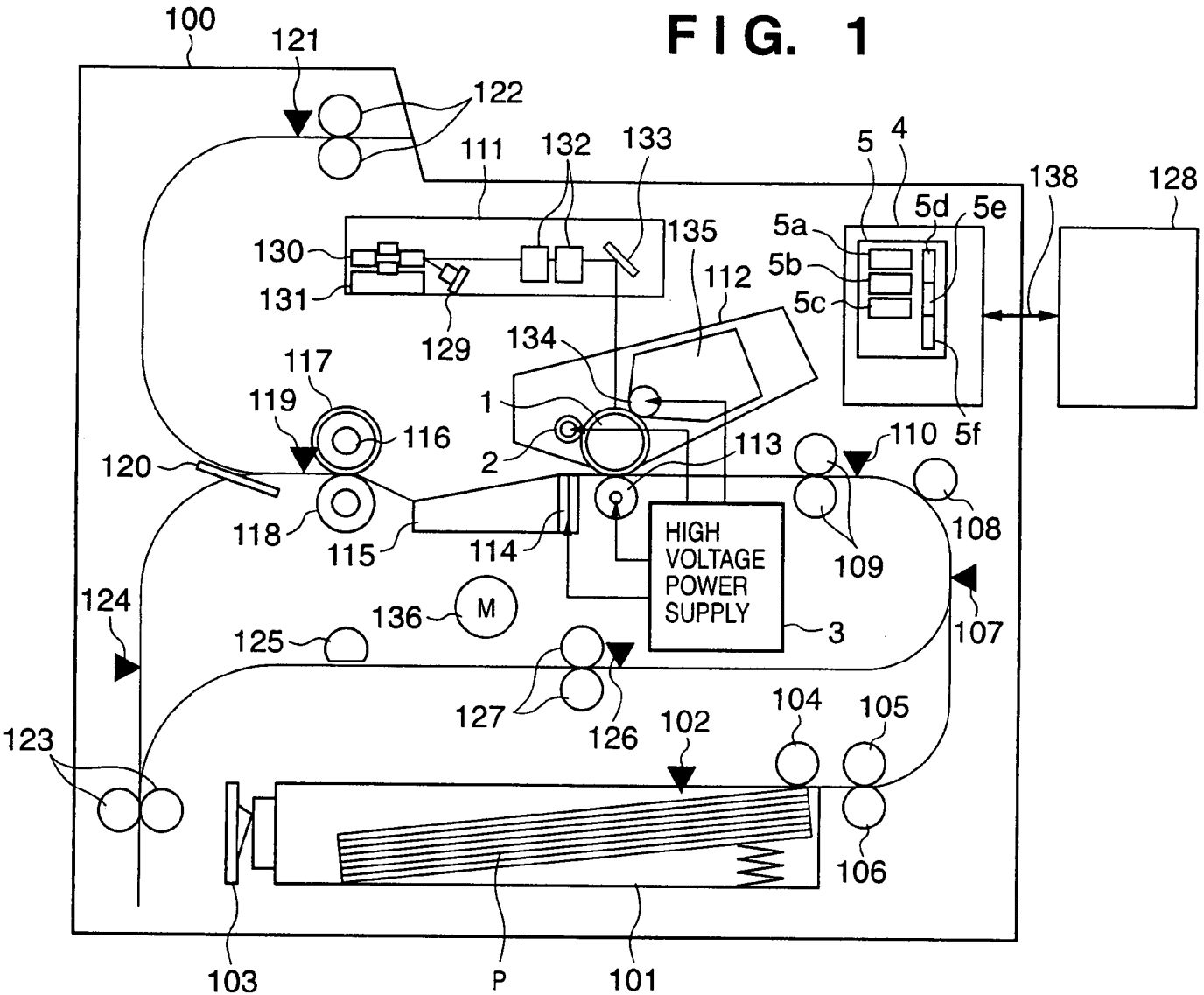
FIG. 1 depicts a view showing the arrangement of an image forming apparatus (laser beam printer) according to the first embodiment of the present invention.

FIG. 1 depicts a view showing the arrangement of a laser beam printer (an image forming apparatus by electrophotography) 100 according to the first embodiment of the present invention.

The laser printer 100 has a deck 101 which stores printing paper sheets P. The printer also has a deck paper presence/absence sensor 102 which detects the presence/absence of the printing paper sheet P in the deck 101, a paper size detection sensor 103 which detects the size of the printing paper sheet P in the deck 101, a pickup roller 104 which picks up the printing paper sheet P from the deck 101, a paper feed roller 105 which conveys the printing paper sheet P picked up by the pickup roller 104, and a retardation roller 106 paired with the paper feed roller 105 to prevent double feed of the printing paper sheet P. A paper feed sensor 107 which detects the paper conveyance state from the deck 101 and a double-side reversing unit (to be described later), a paper conveyance roller 108 to further convey the printing paper sheet P downstream, a registration roller pair 109 which synchronously conveys the printing paper sheet P, and a pre-registration sensor 110 which detects the conveyance state of the printing paper sheet P to the registration roller pair 109 are arranged downstream of the paper feed roller 105.

A process cartridge 112 which forms a toner image on a photosensitive drum 1 on the basis of a laser beam from a laser scanner unit 111 (to be described later), a roller member 113 (to be referred to as a transfer roller hereinafter) to transfer the toner image formed on the photosensitive drum 1 onto the printing paper sheet P, and a discharge member 114 (to be referred to as an antistatic rod hereinafter) to remove electric charges on the printing paper sheet P and promote separation from the photosensitive drum 1 are arranged downstream of the registration roller pair 109. A conveyance guide 115, and a fixing unit which comprises a pair of pressure rollers 118 and fixing roller 117 incorporating a halogen heater 116 to thermally fix the toner image transferred to the printing paper sheet P are arranged downstream of the antistatic rod 114. A fixing delivery sensor 119 which detects the conveyance state from the fixing unit, and a double flapper 120 to switch the destination of the printing paper sheet P conveyed from the fixing unit between the delivery unit and the double-side reversing unit are arranged. A delivery sensor 121 which detects the paper conveyance state of the delivery unit and a delivery roller pair 122 which deliver the printing paper sheet are arranged downstream of the delivery unit.

A reversing roller pair 123 which switches the printing paper sheet P back by rotating in the forward and reverse directions, a reversing sensor 124 which detects the paper conveyance state to the reversing roller pair 123, a D cut roller 125 to convey the printing paper sheet P from the lateral registration unit (not shown) to align the lateral position of the printing paper sheet P, a double-side sensor 126 which detects the conveyance state of the printing paper sheet P in the double-side reversing unit, and a double-side conveyance roller pair 127 to convey the printing paper sheet P from the double-side reversing unit to the paper feed unit are arranged on the side of the double-side reversing unit to turn the printing paper sheet P after the end of single-side printing upside down and feed the paper to the image forming unit again to print both surfaces of the printing paper sheet P.

The scanner unit 111 comprises a laser unit 129 which emits a laser beam modulated on the basis of an image signal sent from an external device (host computer) 128 (to be described later), and a polygon mirror 130, scanner motor 131, imaging lens group 132, and deflecting mirror 133 to scan the laser beam from the laser unit 129 on the photosensitive drum 1. The process cartridge 112 comprises the photosensitive drum 1 necessary for the known electrophotographic process, a charge roller 2 as a charge member, a developing roller 134, and a toner container 135. The process cartridge 112 is detachably arranged in the laser beam printer 100. Referring to FIG. 1, a high voltage power supply unit 3 has not only a charge high voltage circuit (to be described later) but also a high voltage circuit which supplies a desired voltage to the developing roller 134, transfer roller 113, and antistatic rod 114. A main motor 136 supplies driving power to the respective units.

A printer control unit 4 controls the laser printer 100. The printer control unit 4 includes an MPU (microcomputer) 5 comprising a RAM 5*a*, ROM 5*b*, timer 5*c*, digital input/output port (to be referred to as an I/O port hereinafter) 5*d*, analog-to-digital conversion input port (to be referred to as an A/D port hereinafter) 5*e*, and digital-to-analog output port (to be referred to as a D/A port hereinafter) 5*f*, and various kinds of input/output control circuits (not shown). The printer control unit 4 is connected to the external device 128 such as a personal computer through an interface 138.

A charge bias generation circuit according to the embodiment of the present invention will be described next.

Figure 2:
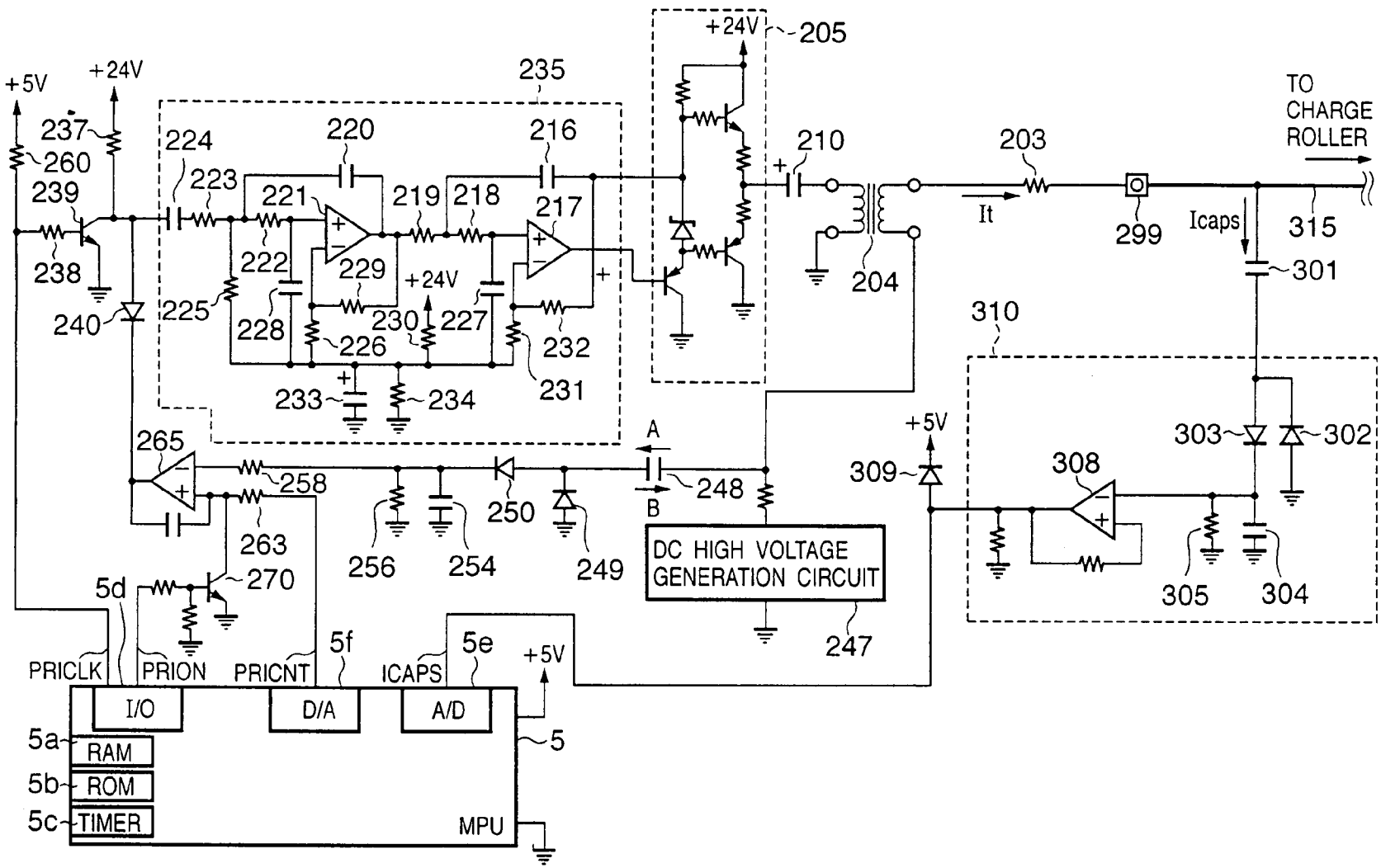
FIG. 2 is a block diagram showing the arrangement of a charge voltage control circuit according to the first embodiment of the present invention.

FIG. 2 is a block diagram for explaining the charge bias generation circuit of the laser beam printer 100 according to the first embodiment of the present invention. This circuit is incorporated in the printer control unit 4. The same reference numerals as in FIG. 1 described above denote the same parts in FIG. 2.

This charge bias generation circuit generates a charge voltage by superposing an AC high voltage on a DC high voltage and outputs the charge voltage from an output terminal 299. When a clock pulse (PRICLK) is output from the I/O port 5*d* of the MPU 5, a transistor 239 executes a switching operation through a pull-up resistor 260 and base resistor 238. The pulse is amplified to a clock pulse having an amplitude corresponding to the output from an operational amplifier 265 connected through a pull-up resistor 237 and a diode 240. When the amplitude is large, the drive voltage amplitude (peak voltage) having a sine wave, which is input to a high voltage transformer 204 (to be described later), also becomes large. As a result, the peak voltage of the AC voltage as a high voltage also increases.

The clock pulse is input, through a capacitor 224, to a filter circuit 235 including resistors 218, 219, 222, 223, 225, 226, 229, and 230 to 234, capacitors 216, 220, 227, 228, and 233, and operational amplifiers 217 and 221. The filter circuit 235 outputs a sine wave centered on +12 V. This output is amplified by a push-pull high voltage transformer drive circuit 205 and input to the primary winding of the high voltage transformer 204 through a capacitor 210. Accordingly, an AC high voltage with a sine wave is generated on the secondary winding side of the high voltage transformer 204. One terminal of the secondary side of the high voltage transformer 204 is connected to a DC high voltage generation circuit 247. A high voltage bias is obtained by superposing the AC high voltage on the DC high voltage output from the DC high voltage generation circuit 247 and output from the output terminal 299 through an output protective resistor 203.

The output terminal 299 and the above-described charge roller 2 are connected by a connection member (conductive member) 315. The charge high voltage bias is applied to the charge roller 2 through the conductive member 315.

Detection of an AC output current (It) of the charge bias generation circuit will be described next.

In this case, the current of the secondary winding of the high voltage transformer 204 is detected to measure the AC output current (It) output from the output terminal 299. The input voltage to the high voltage transformer drive circuit 205 is generated in accordance with the measured AC output current (It). The AC output current (It) generated by driving the high voltage transformer drive circuit 205 passes through a capacitor 248. The half wave in the direction of arrow A flows through a diode 250. The half wave in the direction of arrow B flows through a diode 249. The half wave in the direction of arrow A, which passes through the diode 250, is input to a rectifying circuit including an operational amplifier 265, resistors 256 and 258, and capacitor 254 and converted into a DC voltage. In this case, a voltage (V1) at the negative input terminal of the operational amplifier 265 is given by $$V1 = R256 \times Imean1 \quad (1)$$

where Imean1 is the average value of the half wave of the AC output current (It), and R256 is the resistance value of the resistor 256.

On the other hand, a current control signal (PRICNT) output from the D/A port 5*f* of the MPU 5 is input to the positive input terminal of the operational amplifier 265 through a resistor 263. The current control signal (PRICNT) sets the drive voltage amplitude of the sine wave input to the high voltage transformer 204, i.e., the amplitude level of the AC output current (It). If the voltage (V1) at the negative input terminal of the operational amplifier 265 is lower than the current control signal (PRICNT) voltage, the output voltage from the operational amplifier 265 becomes high. Conversely, if the voltage (V1) at the negative input terminal is higher than the current control signal (PRICNT) voltage, the output voltage from the operational amplifier 265 becomes low.

As described above, when the output voltage from the operational amplifier 265 is high, the amplitude of the clock pulse input to the filter circuit 235 becomes large, and the peak voltage (amplitude voltage) of the AC high voltage becomes high. With this arrangement, the amplitude level of the AC high voltage is controlled such that the AC output current (It) flowing to the secondary side of the high voltage transformer 204 obtains a value corresponding to the current control signal (PRICNT) output from the MPU 5. That is, constant current control corresponding to the current control signal (PRICNT) is executed. A transistor 270 is also connected to the positive input terminal of the operational amplifier 265. The transistor 270 is driven by a signal (PRION) output from the I/O port 5*d* of the MPU 5. When the signal PRION is set to high level to turn on the transistor 270, the potential at the positive input terminal of the operational amplifier 265 can be changed to low level to turn off output of the AC high voltage.

A capacitor current detection circuit 310 (capacitance current detection circuit) connected to the output terminal 299 through a capacitor 301 will be described next.

The capacitor 301 is connected to the conductive member 315 which connects the output terminal 299 to the charge roller 2. A component which can stand a high voltage bias is used. When the charge bias generation circuit is driven to supply a charge high voltage bias from the output terminal 299 to the charge roller 2, the same voltage as the charge high voltage bias is applied to the capacitor 301. A capacitor AC current (Icap) corresponding to the AC voltage of the charge high voltage bias obtained by superposing the AC high voltage on the DC high voltage and an electrostatic capacity (C1) of the capacitor 301 flows to the capacitor 301. The current (Icap) which flows to the capacitor 301 is detected by the capacitor current detection circuit 310 connected to the capacitor 301.

The half wave of the current (Icap) input to the capacitor current detection circuit 310 passes through a diode 303 and is input to a rectifying circuit including a resistor 305 and capacitor 304 and converted into a DC voltage. The converted DC voltage is input to an operational amplifier 308 and output from the output terminal of the operational amplifier 308 as a detection signal (ICAPS) of a capacitor current (icaps). In this way, the capacitor current detection circuit 310 receives the current from the output terminal 299 through the capacitor 301. The current is converted into a voltage signal by the diode, capacitor, resistor, and operational amplifier. The current value (Icap) flowing to the capacitor 301 is obtained on the basis of the voltage signal. For this reason, the circuits on the output side of the capacitor 301 can be low-voltage circuits. In addition, since the current value flowing to the capacitor 301 is directly received, converted into a voltage, and output, the number of components included in the circuit 310 can be decreased.

The voltage level of the detection signal (ICAPS) of the capacitor current (icap) is given by $$ICAPS=R305\times Imean2 \quad (2)$$

where Imean2 is the average value of the half wave of the capacitor AC current (Icap), and R305 is the resistance value of the resistor 305. In equation (2), the voltage level of the detection signal (ICAPS) is represented by "ICAPS".

The signal ICAPS corresponding to the current value flowing to the capacitor 301 is input to the A/D port 5*e* of the MPU 5 and converted into a digital signal. A diode 309 connected to the A/D port 5*e* prevents a voltage equal to or higher than a predetermined voltage from being applied to the A/D port 5*e*. The diode 309 is normally OFF. With this arrangement, the AC current (Icap) flowing to the capacitor 301 can be measured.

The relationship between the AC output current (It) flowing to the high voltage transformer 204 and the capacitor AC current (Icap) flowing to the capacitor 301 will be described.

Figure 3A:
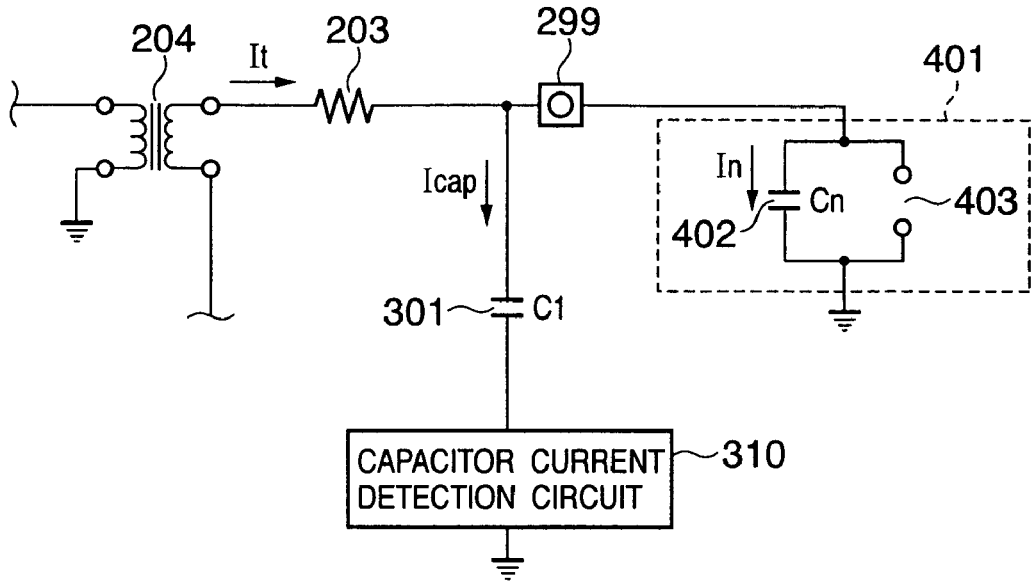
Figure 3B:
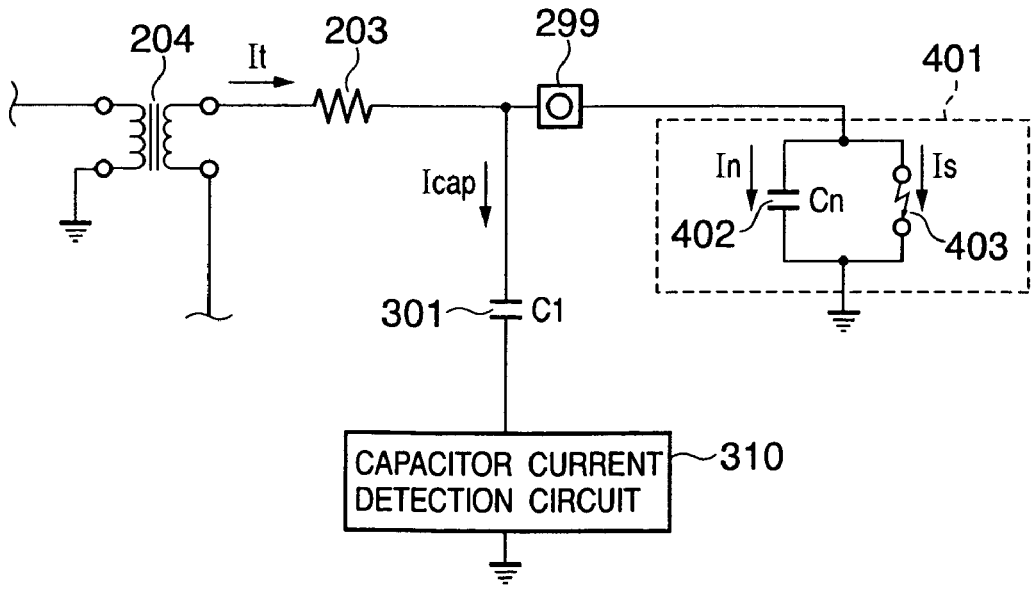

FIGS. 3A and 3B are block diagrams for explaining the relationship between the capacitor AC current (Icap) and the AC output current (It) from the high voltage transformer 204. FIG. 3A shows the relationship when no discharge occurs. FIG. 3B shows the relationship when discharge has occurred.

Referring to FIGS. 3A and 3B, a load 401 schematically indicates the charge roller 2 as an electric circuit connected to the output terminal 299 of the charge bias generation circuit. Reference numeral 402 denotes a capacitive load (Cn) between the charge roller 2 and the photosensitive drum 1; and numeral 403 denotes a discharge load when discharge has occurred between the charge roller 2 and the photosensitive drum 1. The capacitive load current flowing to the capacitive load (Cn) 402 is represented by In. The discharge current flowing to the discharge load 403 when discharge has occurred is represented by Is.

The relationship between the AC output current (It) and the capacitor AC current (Icap) will be described next.

(i) When No Discharge Occurs (FIG. 3A)

When no discharge occurs, i.e., when the AC voltage applied to the charge roller 2 is low, and no discharge occurs between the charge roller 2 and the photosensitive drum 1, no current flows to the discharge load 403. Hence, the AC output current (It), capacitor AC current (Icap), and capacitive load current (In) hold a relationship given by $$It=Icap+In \quad (3)$$

Since the AC voltage applied between the terminals of the capacitor 301 equals the AC voltage applied to the capacitive load (Cn), In and Icap hold a relationship given by $$In/Icap=Cn/C1 \quad (4)$$

From equations (3) and (4), we obtain $$It=(Cn/C1+1)\times Icap \quad (5)$$

That is, when no discharge occurs, the capacitor AC current (Icap) and AC output current (It) have a proportional relationship.

(ii) When Discharge Has Occurred (FIG. 3B)

When the peak voltage of the AC voltage applied to the charge roller 2 exceeds a discharge start voltage (Vth), discharge occurs between the charge roller 2 and the photosensitive drum 1, and a discharge current (Is) flows to the discharge load 403. The AC output current (It), capacitor AC current (Icap), capacitive load current (In), and discharge current (Is) hold a relationship given by $$It=I\text{cap}+In+Is \quad (6)$$

Since equation (4) holds independently of the presence/absence of discharge. Hence, equation (6) can be rewritten to $$It=(Cn/C1+1)\times I\text{cap}+Is \quad (7)$$

Equation (7) indicates that the characteristics of Icap and It when discharge has occurred equal the sum of the discharge current (Is) and the characteristics when no discharge occurs.

Figure 4:
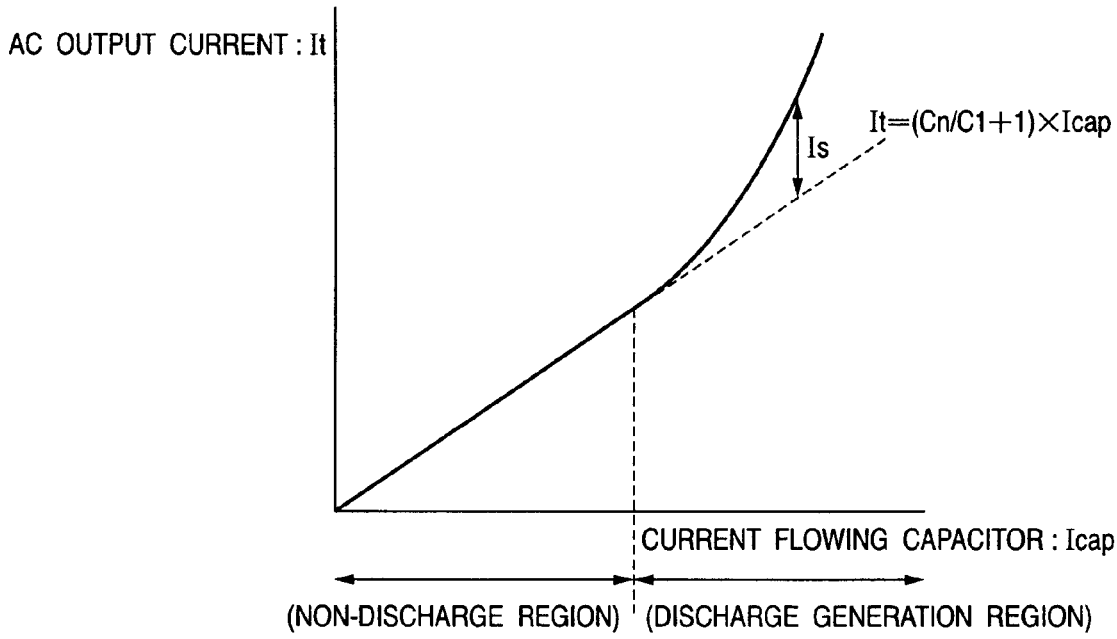
FIG. 4 depicts a graph for explaining the relationship between the capacitor AC current (Icap) and the AC output current (It)

FIG. 4 depicts a graph for explaining the relationship between the capacitor AC current (Icap) and the AC output current (It).

In the non-discharge generation region, the AC output current (It) linearly increases in proportion to the capacitor AC current (Icap).

On the other hand, in the discharge generation region, the AC output current (It) exhibits a characteristic indicated by a line obtained by adding the discharge current (Is) to the line indicating the characteristic in the non-discharge generation region. The generated discharge current value can be detected from this characteristic in accordance with the following procedures.

[Step 1]

An AC current of a level not to cause discharge is applied to the charge roller 2. The characteristic (It=f(Icap)) when no discharge occurs is obtained from the capacitor AC current (Icap) and AC output current (It) at this time.

[Step 2]

An AC current of a level to cause discharge is applied to the charge roller 2. The capacitor AC current (Icap) and AC output current (It) value at this time are compared with the characteristic (It=f(Icap)) calculated in step 1 to obtain the discharge current (Is).

In the charge voltage control according to the first embodiment, the discharge current value Is is obtained in accordance with the above-described procedures, and the discharge current (Is) is controlled by controlling the charge AC voltage value, i.e., the AC voltage to be input to the high voltage transformer drive circuit 205 such that the discharge current (Is) becomes a desired value.

The processing sequence of the charge voltage control according to the first embodiment will be described below.

Figure 5:
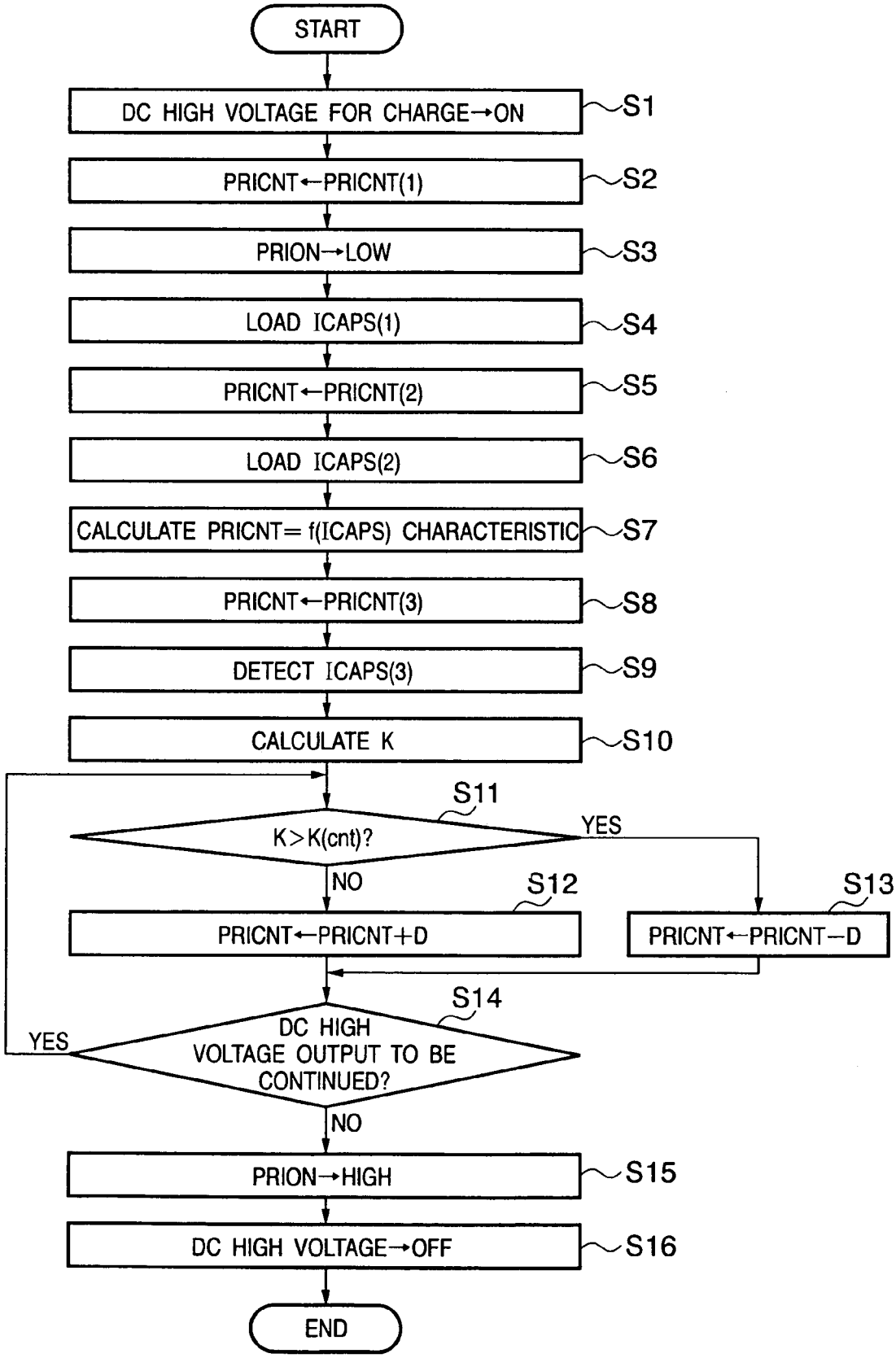
FIG. 5 is a flowchart showing a high charge voltage control sequence in the laser beam printer according to the first embodiment.
Figure 6:
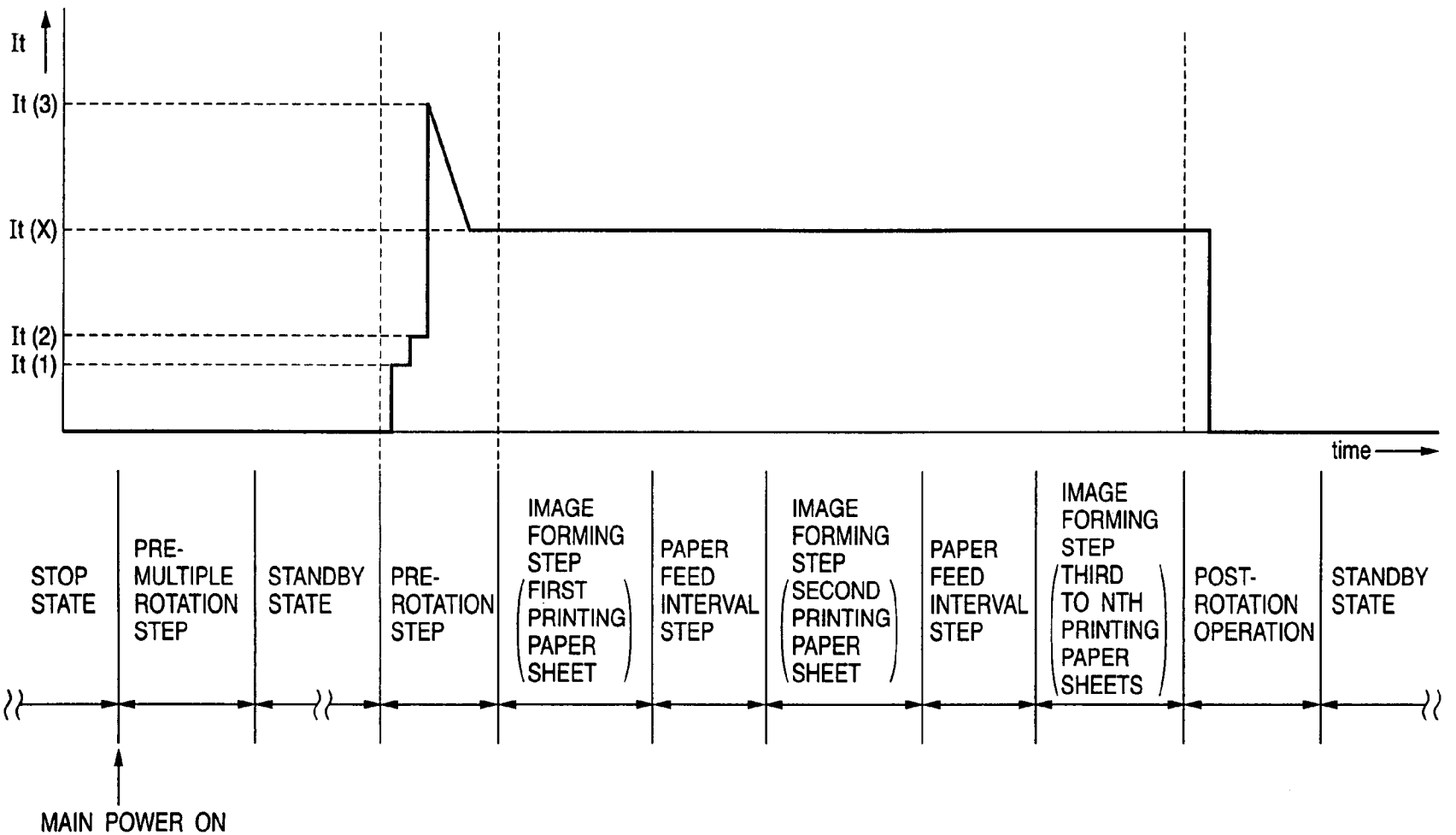
FIG. 6 depicts a view showing the relationship between the change of the charge AC current (It) and the sequence in the print operation according to the first embodiment.

FIG. 5 is a flowchart showing a charge voltage control sequence in the laser beam printer according to the first embodiment. FIG. 6 depicts a view showing the relationship between the control sequence in the print operation and the change of the charge AC current (It). The program which executes the processing is stored in the ROM 5*b* and is executed under the control of the MPU 5.

When the main power of the laser beam printer 100 is turned on, the MPU 5 executes a pre-multiple rotation step of the fixing roller to perform a series of processing operations of, e.g., driving the fixing unit and heating the halogen heater 116 of the fixing roller 117 to a predetermined temperature, as shown in FIG. 6. Then, a standby state is set. When a print start instruction is received from the external device 128 such as a personal computer, a pre-rotation step as predetermined print preparation is executed. After that, an image forming step of executing an image forming operation on a printing paper sheet by a series of electrophotographic processes starts. AC output currents It(1), It(2), and It(3) shown in FIG. 6 correspond to AC output current values corresponding to points A1, A2, and B1 shown in FIG. 7A to be described later.

The series of charge voltage control operations indicated by the flowchart in FIG. 5 are started during the period of the pre-rotation step shown in FIG. 6. First, in step S1, the MPU 5 sets the signal level of the constant current control signal (PRICNT) such that a charge AC voltage (bias) of a predetermined voltage level not to cause discharge is output. This processing is executed during the period of the pre-rotation step. The capacitor AC current (Icap) and AC output current (It) in the non-discharge generation region where no discharge occurs are detected.

Figure 7A:
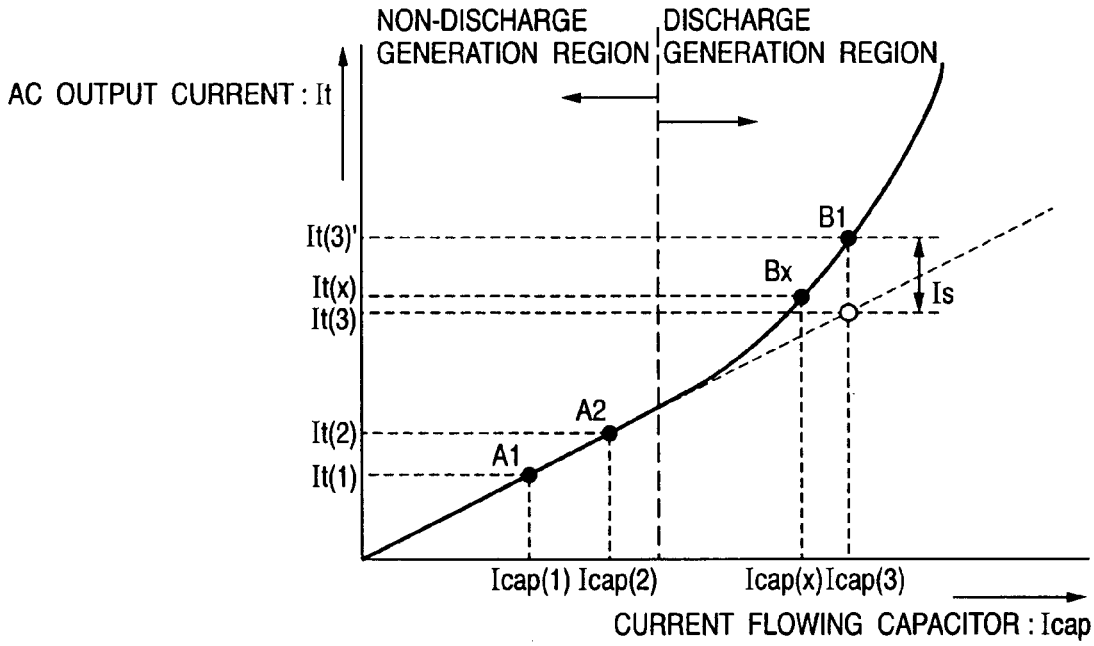
FIG. 7A depicts a graph showing the characteristics of the output charge AC current (It) and capacitor AC current (Icap) when a charge AC current is applied to the charge roller in the first embodiment.
Figure 7B:
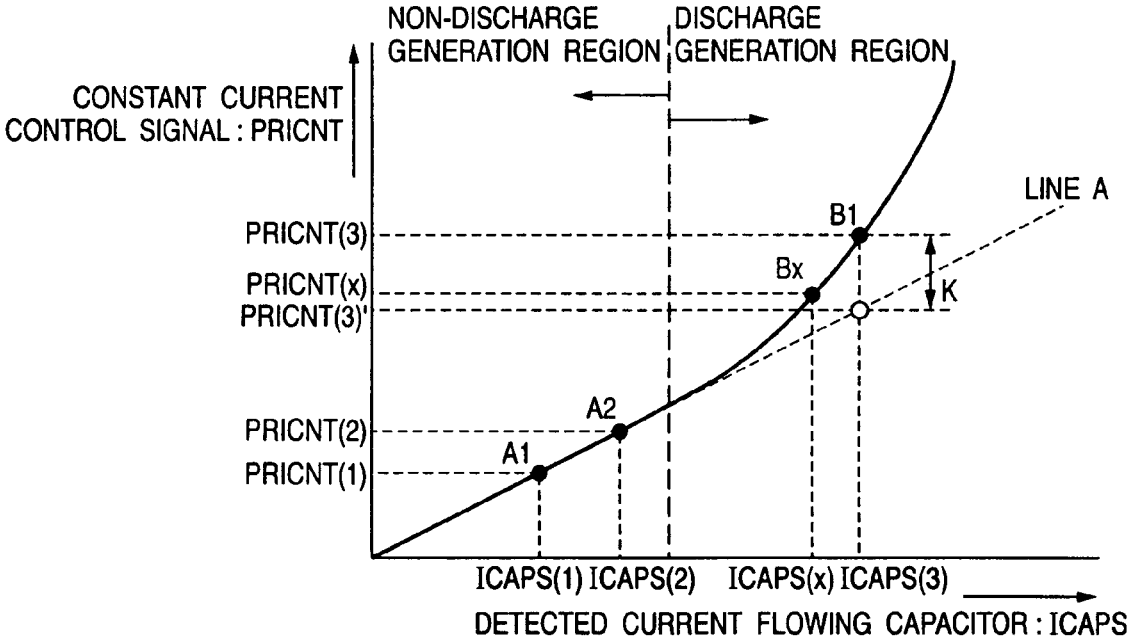
FIG. 7B depicts a graph for explaining the relationship between a constant current control signal (PRICNT) and a capacitor AC current detection signal (ICAPS) in correspondence with FIG. 7A.

FIG. 7A is a graph showing the characteristics of the AC output current (It) and capacitor AC current (Icap) when the charge AC current is applied to the charge roller 2. FIG. 7B is a graph for explaining the relationship between the constant current control signal (PRICNT) and the capacitor AC current detection signal (ICAPS) in correspondence with FIG. 7A.

In the process in steps S2 to S7, a charge AC voltage to obtain the AC output current (It) of level not to cause discharge is applied, and sampling is executed at the two points A1 and A2 shown in FIGS. 7A and 7B. A1 indicates a point where the transformer AC current is It(1), and A2 indicates a point where the AC output current is It(2).

First, in step S2, the MPU 5 sets the signal level of the constant current control signal (PRICNT) output from the D/A port 5*f* to PRICNT(1). In step S3, the MPU 5 switches the charge AC bias ON signal (PRION) to low level to turn off the transistor 270 and start outputting the charge AC bias. The flow advances to step S4. The MPU 5 receives a signal level (ICAPS(1)) of the capacitor AC current detection signal (ICAPS) for the A/D port 5*e* and A/D-converts the signal.

The flow advances to step S5. The constant current control signal (PRICNT) output from the D/A port 5*f* of the MPU 5 is switched to PRICNT(2). The flow advances to step S6. The signal level (ICAPS(2)) of the capacitor AC current detection signal (ICAPS) is received from the A/D port 5*e* and A/D-converted. The flow advances to step S7. The characteristic expression of the constant current control signal (PRICNT) in the non-discharge generation region is calculated by using the capacitor AC current sampling results at the points (A1) and (A2), i.e., the current values input in steps S4 and S6. The characteristic expression is given by $$\text{PRICNT}=f(I\text{CAPS})=A\times I\text{CAPS}+B \quad (8)$$

where A and B are constants. In the non-discharge generation region, no discharge occurs, and no discharge current (Is) is generated. Hence, the constant current control signal (PRICNT) corresponds to the capacitive load current (In) which flows to the contact portion between the charge roller 2 and the photosensitive drum 1.

The constants A and B are calculated by $$A=\{\text{PRICNT}(1)-\text{PRICNT}(2)\}/\{I\text{CAPS}(1)-I\text{CAPS}(2)\} \quad (9)$$

$$B=\{I\text{CAPS}(2)\times\text{PRICNT}(1)-I\text{CAPS}(1)\times\text{PRICNT}(2)\}/\{I\text{CAPS}(1)-I\text{CAPS}(2)\} \quad (10)$$

The process in steps S8 to S14 is started during the pre-rotation step shown in FIG. 6 and executed until the end of the image forming step. The charge AC voltage is generated in the discharge generation region where discharge occurs, and the AC output current (It) is controlled such that the discharge current (Is) obtains a desired value.

First, the MPU 5 outputs PRICNT to change the peak voltage of the charge AC voltage such that the AC output current (It) falls within the discharge region and detects the capacitor AC current (Icap) at the point B1 shown in FIG. 7A. As shown in FIG. 7A, B1 indicates a point where the AC output current (It) becomes It(3). The level of the AC output current (It(3)) is set such that the sufficient discharge current (Is) is generated independently of the environmental conditions, and no charge failures are caused by shortage of the discharge current (Is).

In step S8, the MPU 5 sets the constant current control signal (PRICNT) output from the D/A port 5*f* to PRICNT(3) to change the AC output current level to It(3). In step S9, the value (ICAPS(3)) of the capacitor AC current detection signal (ICAPS) at that time is received from the A/D port 5*e* and A/D-converted. The flow advances to step S10. The MPU 5 calculates K corresponding to the discharge current value (Is) at the point B1 by using $$K=\mathrm{PRICNT}(3)-f(\mathrm{ICAPS}(3)) \tag{11}$$

where K is the level of the constant current control signal (PRICNT) corresponding to the discharge current value (Is). In the non-discharge generation region, f(ICAPS) represented by equation (8) indicates the characteristic expression of the constant current control signal (PRICNT). In the discharge generation region, however, discharge occurs, and the discharge current (Is) is generated. For this reason, the constant current control signal (PRICNT) does not correspond to the capacitive load current (In) which flows to the contact portion between the charge roller 2 and the photosensitive drum 1. That is, in the discharge generation region, f(ICAPS(3)) is a signal corresponding to the capacitive load current (In) which flows to the contact portion between the charge roller 2 and the photosensitive drum 1. In the discharge generation region, the difference between the constant current control signal (PRICNT) and the signal corresponding to the capacitive load current (In) which flows to the contact portion between the charge roller 2 and the photosensitive drum 1 is the signal (K) corresponding to the discharge current (Is).

In step S11, the MPU 5 compares K corresponding to the discharge current (Is) calculated in step S10 with a level (K(cnt)) of the constant current control signal (PRICNT) corresponding to a desired discharge current (Is(cnt)). If K>K(cnt), i.e., if the discharge current (Is) is larger than the desired value (Is(cnt)), the flow advances to step S13. In step S13, the level of the signal PRICNT is decreased by an amount corresponding to a digital value D to drop the output voltage from the operational amplifier 265 and decrease the AC output current (It). With this processing, the MPU 5 decreases the discharge current (Is) closer to the desired discharge current value (Is(cnt)). In this case, D is a predetermined digital value (e.g., a 1-bit value) to be output to the D/A port 5*f* of the MPU 5.

If K<K(cnt) in step S11, i.e., if the discharge current is smaller than the desired value (Is(cnt)), the flow advances to step S12. In step S12, the level of the signal PRICNT is increased by an amount corresponding to the digital value D to raise the output voltage from the operational amplifier 265 and increase the AC output current (It). With this processing, the MPU increases the discharge current (Is) closer to the desired discharge current value (Is(cnt)). When step S12 or S13 is executed, the flow advances to step S14. The MPU 5 determines whether the output of the charge voltage (bias) is to be continued. If YES in step S14, the flow returns to step S11 to compare the discharge current (Is) with the desired value (Is(cnt)) again. By repeating the processing in steps S11 to S14, the MPU 5 controls the AC output current (It) such that the discharge current value equals the desired value (Is(cnt)) (point (Bx shown in FIGS. 7A and 7B)).

Accordingly, in the image forming step shown in FIG. 6, the AC output current (It) is controlled to a value (It(X)) corresponding to the point (Bx shown in FIGS. 7A and 7B) at which the discharge current value equals the desired value (Is(cnt)).

The process in steps S15 and S16 is executed and ended during the period of the post-rotation step. More specifically, if it is determined in step S14 that output of the charge voltage (bias) is to be stopped, the flow advances to step S15. The MPU 5 switches the charge AC bias ON signal (PRION) to high level to turn on the transistor 270 to stop the output of the charge AC bias. In step S16, the output of the charge DC bias is stopped, thus ending the series of processing operations of charge voltage control.

As described above, in the laser beam printer 100 as the image forming apparatus according to the first embodiment, the capacitor 301 serving as a capacitive member is connected to the conductive member 315 which connects the output terminal 299 to the charge roller 2. The AC current (Icap) which flows to the capacitor 301 is compared with the AC output current (It) which is output from the output terminal 299, thereby detecting the discharge current amount (Is) which is generated between the charge roller 2 and the photosensitive drum 1. The voltage, i.e., the AC output current (It) to be input to the high voltage transformer 205 is controlled such that the discharge current (Is) always has the desired value (Is(cnt)). With this processing, charge current control to set the discharge current to the desired value (Is(cnt)) is implemented.

With this arrangement, the number of components of the charge bias generation circuit can be made smaller than in the conventional circuit. Especially, since the only component in which a high voltage is applied between the terminals is the capacitor 301, the following effects can be obtained.

The manufacturing cost of the high voltage circuit can be lower than before.

The high voltage circuit can be made more compact than before.

[Second Embodiment]

The second embodiment of the present invention will be described next. The basic arrangement of an image forming apparatus according to the second embodiment is the same as that of the above-described first embodiment except in the control processing method after detection of a discharge current value (It). The object of the image forming apparatus according to the second embodiment is to prevent any errors such as abnormal images even when the characteristic of a charge roller 2 varies in the print operation, and the capacitive component of the load increases. More specifically, in the above-described first embodiment, control is executed to always set the discharge current to the desired value by detecting the discharge current in forming an image and sequentially adjusting the level of the charge AC current on the basis of the detection result. The second embodiment can cope with an increase in capacitive component of the charge roller 2 even after the start of print operation.

Figure 8:
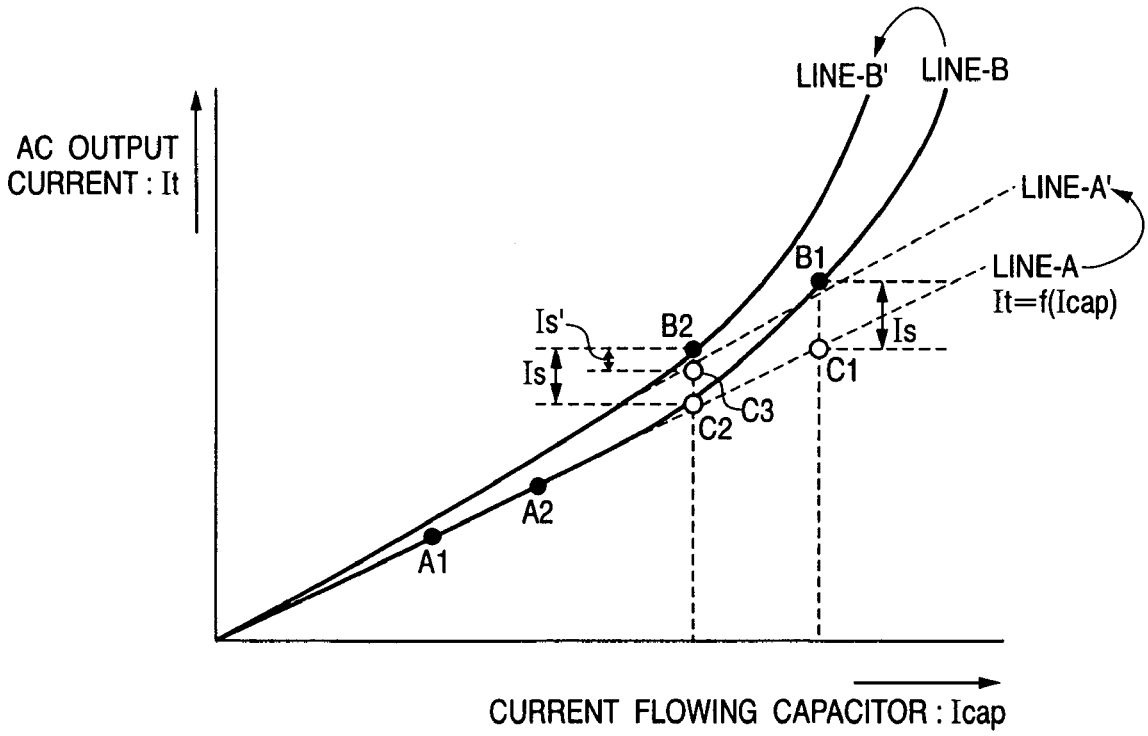
FIG. 8 depicts a graph for explaining variations in capacitor current (Icap) and AC output current (It) when the characteristic of the charge roller according to the embodiment varies.

FIG. 8 is a graph for explaining variations in capacitor current (Icap) and AC output current (It) when the characteristic of the charge roller 2 varies. LINE-A LINE-A', LINE-B, and LINE-B' in FIG. 8 represent the following characteristics.

LINE-A: a line in the non-discharge generation region at the start of print operation LINE-B: a line in the discharge generation region at the start of print operation LINE-A': a line in the non-discharge generation region when the characteristic of the charge roller 2 varies after the start of print operation LINE-B': a line in the discharge generation region when the characteristic of the charge roller 2 varies after the start of print operation In the above-described first embodiment, the capacitor currents at the points A1 and A2 are obtained, thereby calculating LINE-A as the Icap—It characteristic in the non-discharge region. The discharge current amount in the discharge generation region is detected by using the calculated characteristic. Hence, if, after calculation of LINE-A, the characteristic represented by LINE-A changes to the characteristic represented by LINE-A' due to the variation in characteristic of the charge roller 2, the discharge current cannot correctly be calculated.

Referring to FIG. 8, B1 is a control point at the start of printing. Discharge is caused by outputting a constant current control signal (PRICNT) corresponding to a point C1 on LINE-A, and control is executed by a value obtained by adding a desired discharge current value (Is) to the capacitor current (Icap) at that time. B2 is a control point when image formation is continuously executed, and the characteristic of the charge roller 2 varies from that at calculation of LINE-A. At the point B2, a point C2 on LINE-A is calculated, and control is executed such that the discharge current value calculated by using the point C2 equals the desired value (Is). However, since LINE-A has changed to LINE-A' due to the variation in characteristic of the charge roller 2, a discharge current Is' calculated at the point B2 and point C3 is generated in fact. That is, the discharge current control value is Is', which is smaller than the desired value (Is). When the discharge current value is controlled to a value smaller than the desired value, the charge roller 2 in forming an image is insufficiently charged, and an error such as an abnormal image occurs.

In the second embodiment, as described above, control is executed to prevent any errors such as abnormality in formed images caused by shortage of the discharge current even when the characteristic of the charge roller 2 varies during the print operation.

The processing sequence of the charge voltage control according to the second embodiment will be described below.

Figure 10:
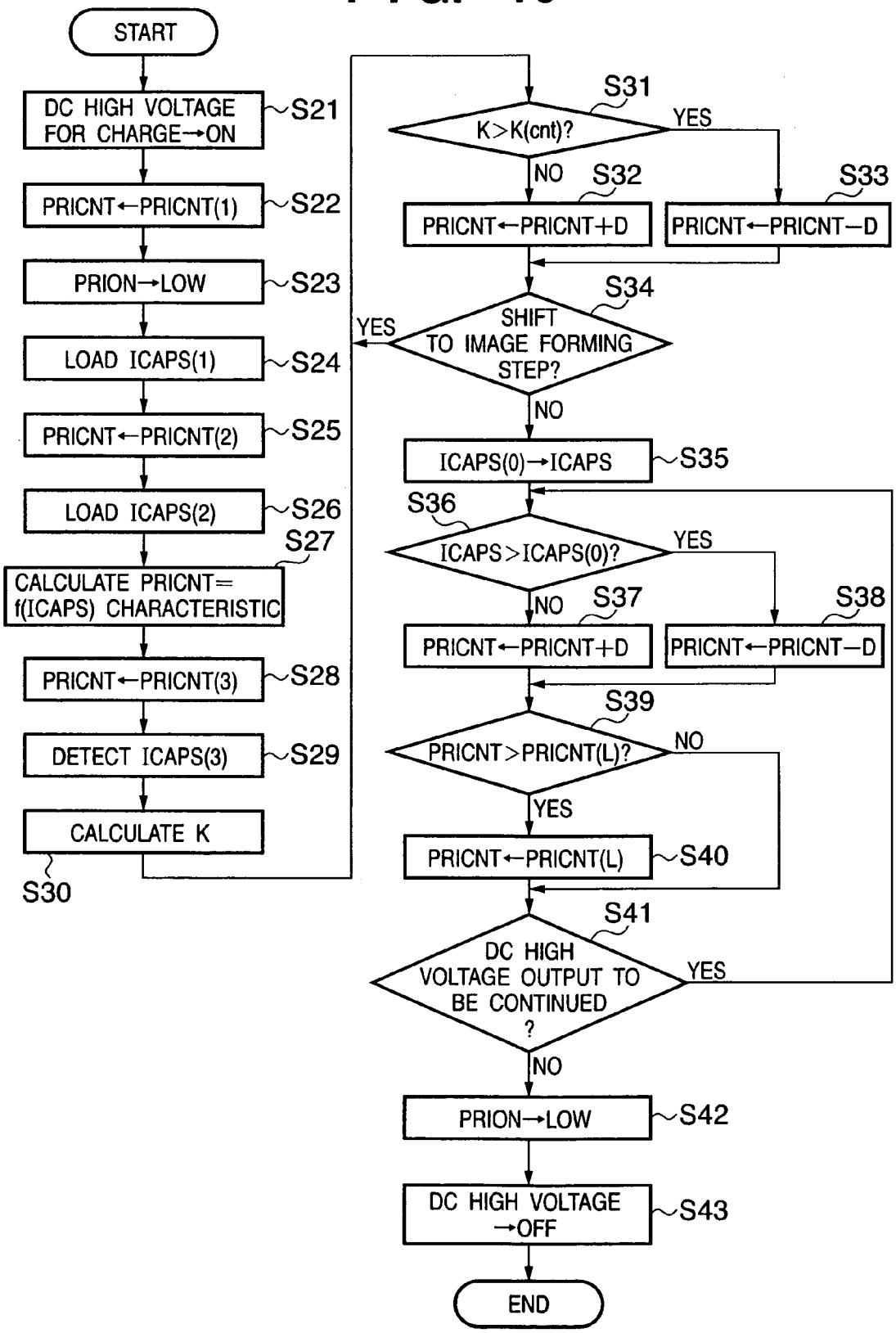
FIG. 10 is a flowchart showing a high charge voltage control sequence in a laser beam printer according to the second embodiment of the present invention.
Figure 11:
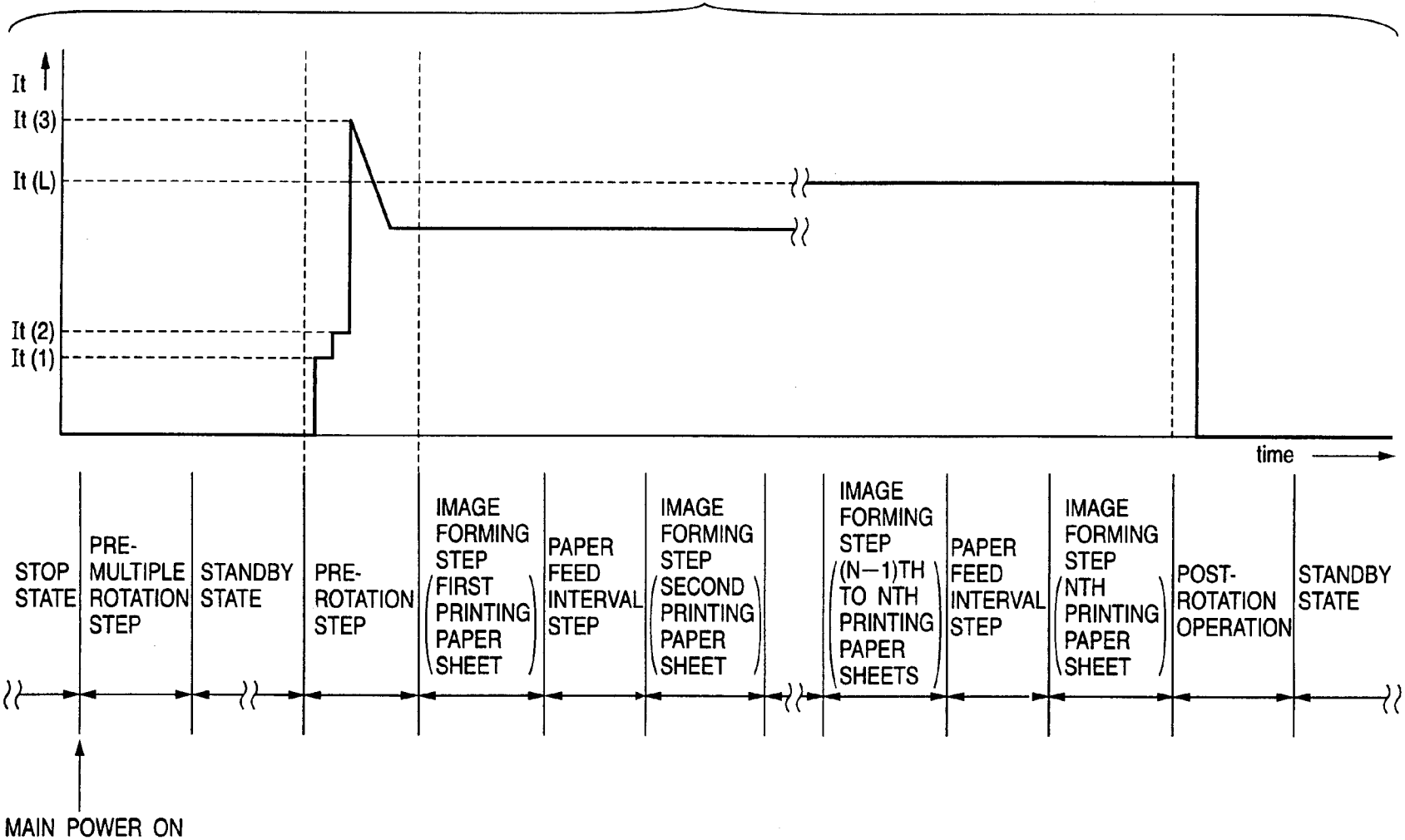
FIG. 11 depicts a view showing the relationship between the change of a charge AC current (It) and the sequence in the print operation according to the second embodiment.

FIG. 10 is a flowchart showing a high charge voltage control sequence in a laser beam printer according to the second embodiment. FIG. 11 depicts a view showing the relationship between the sequence in the print operation and the change of the charge AC current (It). The program which executes the processing is stored in a ROM 5*b* and is executed under the control of an MPU 5.

Steps S21 to S34 according to the second embodiment are executed during pre-rotation shown in FIG. 11. This processing is basically the same as the processing in steps S1 to S14 according to the above-described first embodiment. When these steps are executed, the AC output current (It) is controlled to a level at which the discharge current has the desired value (Is). In step S34, it is determined whether the image forming step is to be started. If YES in step S34, the flow advances to step S35.

The process in steps S35 to S41 is started when image formation processing for the first printing paper sheet starts in FIG. 11 and continued until image formation processing for the Nth printing paper sheet is ended.

First, in step S35, a constant (ICAPS(0)) is set. The value of a capacitor current detection signal (ICAPS) when step S35 starts is set to the constant (ICAPS(0)).

Figure 9A:
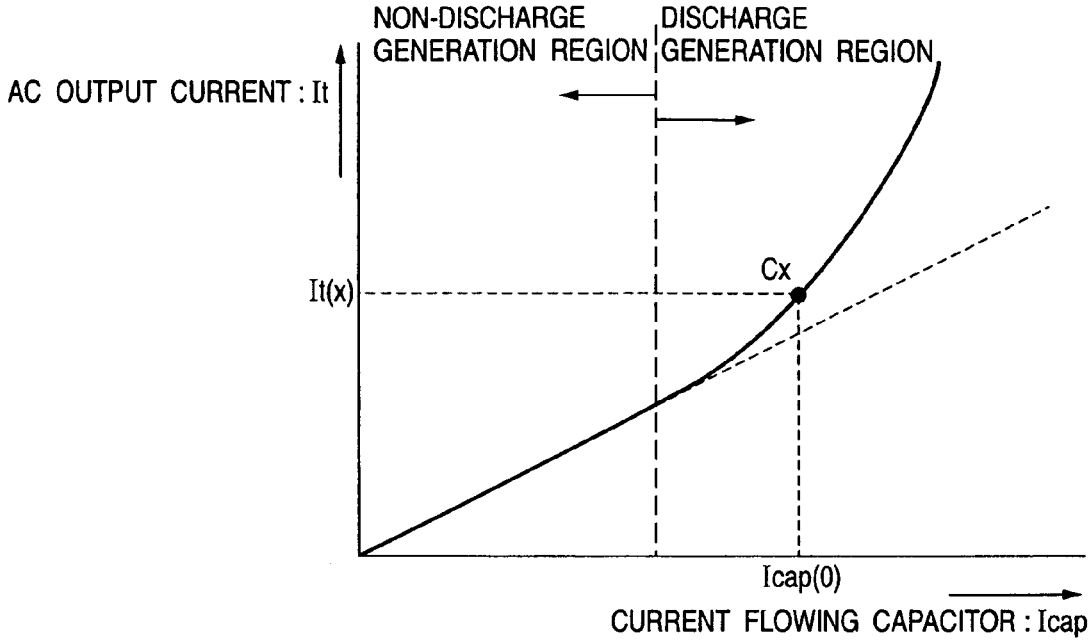
FIG. 9A depicts a graph showing the charge AC current (It) vs. capacitor AC current (Icap) characteristic.
Figure 9B:
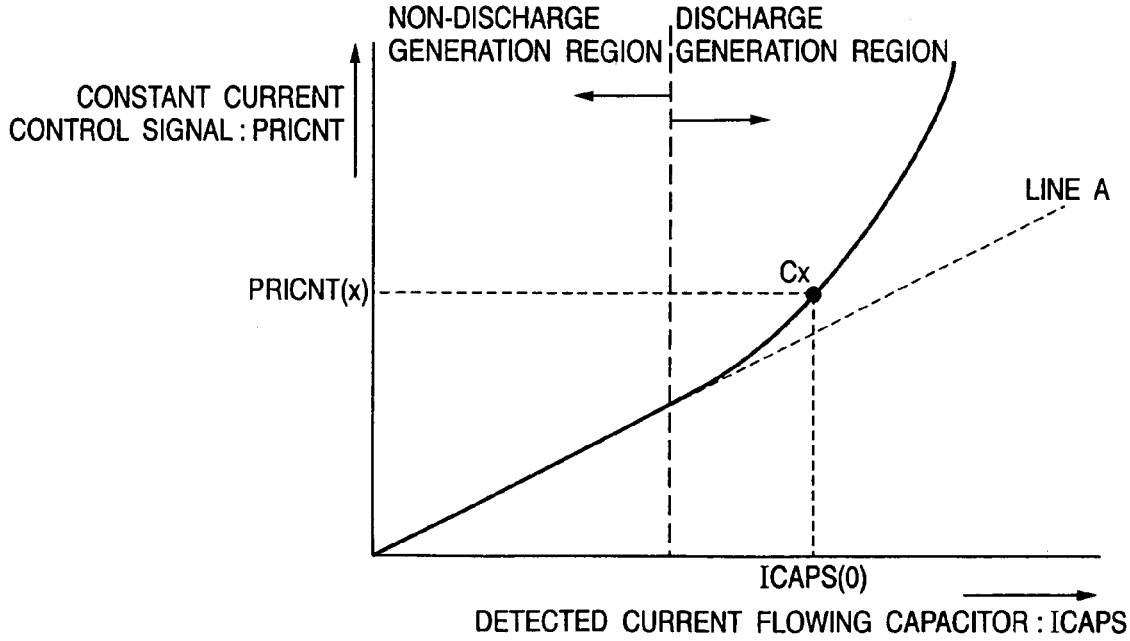
FIG. 9B is a graph showing the constant current control signal (PRICNT) vs. capacitor AC current detection signal (ICAPS) characteristic in correspondence with FIG. 7B.

FIG. 9A is a graph showing the charge AC current (It) vs. capacitor AC current (Icap) characteristic. FIG. 9B is a graph showing the constant current control signal (PRICNT) vs. capacitor AC current detection signal (ICAPS) characteristic in correspondence with FIG. 7B.

The flow advances to step S36 to compare the constant (ICAPS(0)) set in step S35 with the value of the detected capacitor current detection signal (ICAPS). If ICAPS>ICAPS(0), the flow advances to step S38. In step S38, the constant current control signal (PRICNT) output from a D/A port 5*f* of the MPU 5 is decreased by D to decrease the AC output current. Accordingly, the capacitor AC current (Icap) becomes small. In this case, D is a value corresponding to a predetermined digital value (e.g., a 1-bit value) to be output to the D/A port 5*f* of the MPU 5.

If ICAPS<ICAPS(0) in step S36, the flow advances to step S37. In step S37, the constant current control signal (PRICNT) output from the D/A port 5*f* of the MPU 5 is increased by D to increase the AC output current. Accordingly, the detected capacitor AC current (Icap) becomes large. More specifically, in steps S36 to S38, the constant current control signal (PRICNT) is adjusted such that the capacitor AC current (Icap) becomes closer to the value of the capacitor current (ICAPS(0)) set in step S36. This means that control at a target point Cx is executed.

In step S39, the constant current detection signal (PRICNT) and a predetermined constant (PRICNT(L)) when step S39 starts are compared. PRICNT(L) is a value controlled to an upper limit value (It(L)) of the AC output current (It). If PRICNT>PRICNT(L), the flow advances to step S40 to change the set value of PRICNT to PRICNT(L). Then, the flow advances to step S41. If NO in step S39, the flow immediately jumps to step S41. In step S41, it is determined whether the output of the charge bias is to be continued. If YES in step S41, the flow returns to step S36 to execute the above-described processing for comparing the constant (ICAPS(0)) with the value of the capacitor current detection signal (ICAPS) again. By repeating the processing in steps S36 to S41, the charge AC bias is controlled such that the capacitor AC current (Icap) equals the level of the capacitor current (ICAP(0)) when step S35 is started. In these processing steps, the charge AC current (It) is controlled to be equal to or smaller than the upper limit value (It(L)).

The process in steps S42 and S43 is executed and ended during the period of the post-rotation step shown in FIG. 11. If it is determined in step S41 that output of the charge bias is to be stopped, the flow advances to step S42. A charge AC bias ON signal (PRION) is switched to high level to stop the output of the charge AC bias. In step S43, the charge DC bias is not supplied, thus ending the series of charge voltage control.

Figure 12A:
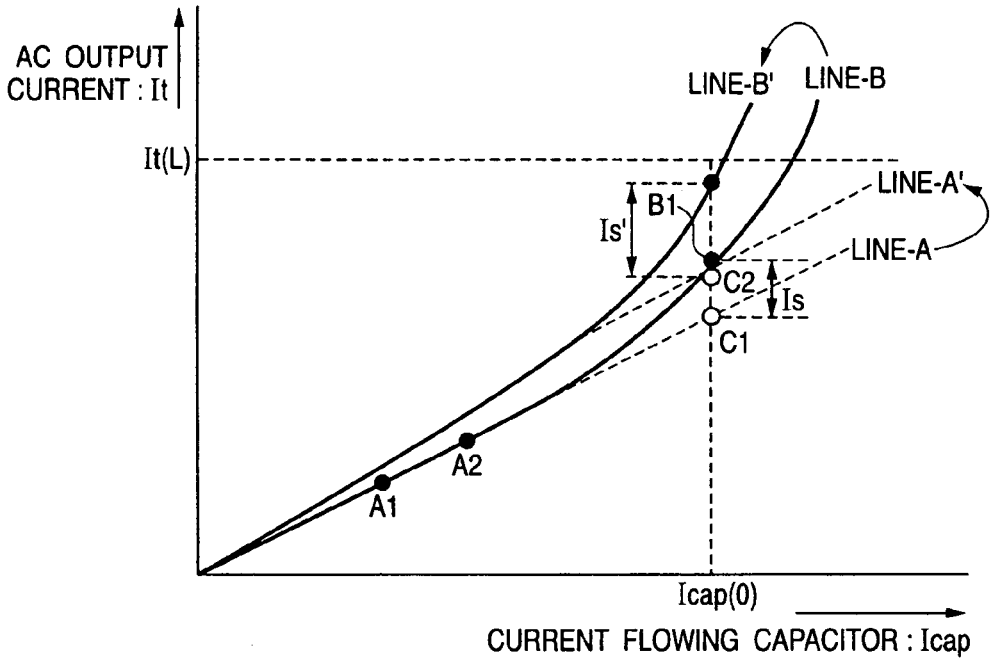
FIGS. 12A and 12B depict graphs for explaining a change in discharge current value when control according to the second embodiment is executed, and the capacitance component of a charge roller 2 increases during control.
Figure 12B:
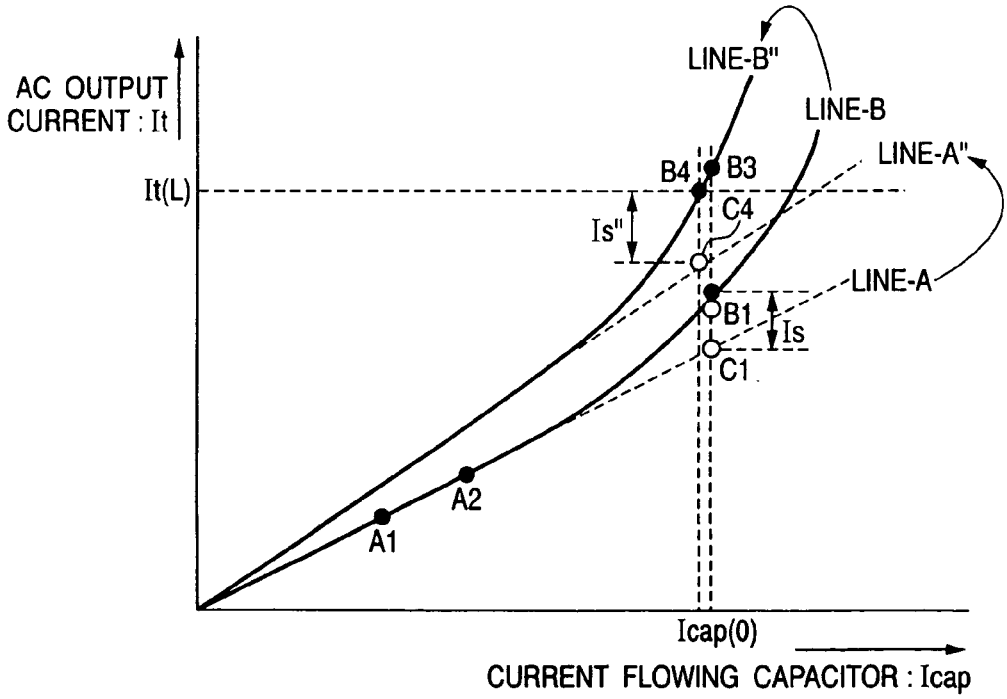

FIGS. 12A and 12B depict graphs for explaining a change in discharge current value when control according to the second embodiment is executed, and the capacitance component of the charge roller 2 increases during the control. The increase amount of the capacitance component of the charge roller 2 changes between FIGS. 12A and 12B.

Case Shown in FIG. 12A

The relationship between the AC output current (It) and the capacitor AC current (Icap) at the start of printing is indicated by characteristic lines LINE-A and LINE-B1. In the pre-rotation step, discharge current control is done at the point B1. At this time, the discharge current value is (Is), and the capacitor AC current is (Icap(0)). When the processing changes from the pre-rotation step to the image forming step, control is executed such that capacitor current (Icap) =Icap(0) holds. If the capacitance component of the charge roller 2 increases during the image forming step, and the above-described characteristics indicated by LINE-A and LINE-B1 shift to those indicated by characteristic lines LINE-A' and LINE-B', control is executed not at the point B1 but at the point B2. The discharge current value at this time is Is' which is calculated as the difference between the AC output current corresponding to the point B2 and that corresponding to the point C2 on the line LINE-B'. Since Is'>Is, the discharge current value increases as the capacitance component of the charge roller 2 increases.

Case Shown in FIG. 12B

When the increase in capacitance component of the charge roller 2 is larger with respect to the characteristic lines LINE-A' and LINE-B' shown in FIG. 12A, the characteristics are represented by characteristic lines LINE-A" and LINE-B" in FIG. 12B. The AC output current corresponding to a point B3 on the characteristic line LINE-B" is larger than the limit value (It(L)) of the AC output current.

In the control according to the second embodiment, when the AC output current (It) exceeds It(L), control is executed on the basis of It=It(L). Actually, control is executed at a point B4 in FIG. 12B. The discharge current value at this time is Is" which is calculated as the difference between the AC output current corresponding to the point B4 and that corresponding to a point C4 on the characteristic line LINE-B".

As described above, according to the image forming apparatus of the second embodiment, a capacitor 301 serving as a capacitive member is connected to a conductive member 315 which connects a charge voltage output terminal 299 to the charge roller 2. The AC current (Icap) which flows to the capacitor 301 is compared with the AC output current (It) which is output from the charge voltage output terminal 299, thereby detecting the discharge current amount which is generated between the charge roller 2 and a photosensitive drum 1. The AC output current (It) is sequentially controlled such that the discharge current has a desired value during a predetermined period from the start of print operation to the pre-rotation step. After the predetermined period, the AC output current (It) is sequentially controlled such that a predetermined value is obtained as Icap at the end of the pre-rotation step. With this processing, charge current control is implemented.

With this arrangement, the number of components included in the charge AC circuit can be decreased. Especially, since the only component in which a high voltage is applied between the terminals is the capacitor 301, the following effects can be obtained.

The manufacturing cost of the high voltage circuit can be lower than before.

The high voltage circuit can be made more compact than before.

In addition, when the electrical characteristic of the charge roller 2 varies during the print operation, and the capacitance component of the charge roller 2 increases, the discharge current increases accordingly. Hence, any errors such as abnormal images caused by shortage of the discharge current can be prevented.

As described above, according to the above-described embodiment, a capacitive member is connected to the connection member which connects the charge voltage output terminal to the charge roller. The AC current (Icap) which flows to the capacitive member is compared with the AC output current (It) output from the charge voltage output terminal, thereby detecting the discharge current amount generated between the charge roller and the photosensitive drum. Discharge current control is implemented by controlling the AC output current (It) such that the detected discharge current amount becomes a desired value.

Accordingly, the charge AC circuit can have a small-scale arrangement, and the manufacturing cost of the high voltage circuit can be reduced. In addition, the high voltage circuit can be made more compact than before.

[Third Embodiment]

The third embodiment of the present invention will be described next. The arrangement of a laser beam printer (an image forming apparatus using electrophotography) according to the third embodiment is the same as the arrangement (FIG. 1) of the printer according to the above-described first embodiment, and a description thereof will be omitted.

Figure 13:
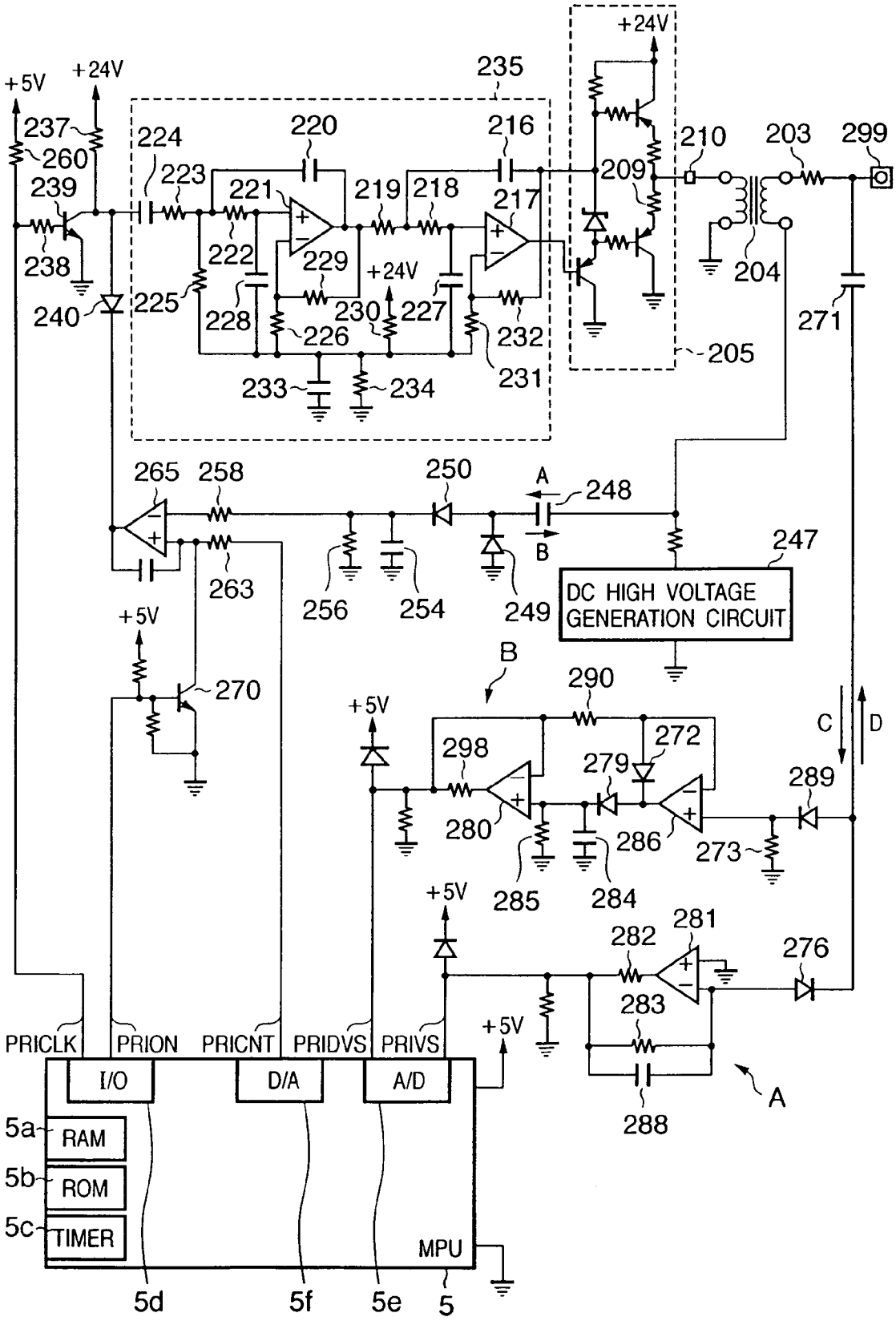
FIG. 13 is a block diagram showing the arrangement of a charge voltage control circuit according to the third embodiment of the present invention.

FIG. 13 is a block diagram for explaining a charge bias generation circuit in a laser beam printer 100 according to the third embodiment of the present invention. This circuit is incorporated into a printer control unit 4. The same reference numerals as in FIGS. 1 and 2 described above denote the same parts in FIG. 13.

This charge bias generation circuit generates a charge voltage by superposing an AC high voltage on a DC high voltage and outputs the charge voltage from an output terminal 299. When a clock pulse (PRICLK) is output from an I/O port 5*d* of an MPU 5, a transistor 239 executes a switching operation through a pull-up resistor 260 and base resistor 238. The pulse is amplified to a clock pulse having an amplitude corresponding to the output from an operational amplifier 265 connected through a pull-up resistor 237 and a diode 240. When the amplitude is large, the drive voltage amplitude (peak voltage) having a sine wave, which is input to a high voltage transformer 204 (to be described later), also becomes large. As a result, the peak voltage of the AC voltage as a high voltage also increases.

The clock pulse is input, through a capacitor 224, to a filter circuit 235 including resistors 218, 219, 222, 223, 225, 226, 229, and 230 to 234, capacitors 216, 220, 227, 228, and 233, and operational amplifiers 217 and 221. The filter circuit 235 outputs a sine wave centered on +12 V. This output is amplified by a push-pull high voltage transformer drive circuit 205 and input to the primary winding of the high voltage transformer 204 through a capacitor 210. Accordingly, an AC high voltage with a sine wave is generated on the secondary winding side of the high voltage transformer 204. One terminal of the secondary side of the high voltage transformer 204 is connected to a DC high voltage generation circuit 247. A high voltage bias is obtained by superposing the AC high voltage on the DC high voltage output from the DC high voltage generation circuit 247 and output from the output terminal 299 through an output protective resistor 203. A high charge voltage bias is applied from the output terminal 299 to a charge roller 2.

Detection of an AC output current (It) of the charge bias generation circuit will be described next.

In this case, the current of the secondary winding of the high voltage transformer 204 is detected to execute feedback control to generate an input voltage to the high voltage transformer drive circuit 205 in accordance with the AC output current (It) output from the output terminal 299. The AC output current (It) generated by driving the above-described high voltage transformer drive circuit 205 passes through a capacitor 248. The half wave in the direction of arrow A flows through a diode 250. The half wave in the direction of arrow B flows through a diode 249. The half wave in the direction of arrow A, which passes through the diode 250, is converted into a DC voltage by an integrating circuit including an operational amplifier 265, resistors 256 and 258, and capacitor 254. In this case, a voltage (Vn) at the negative input terminal of the operational amplifier 265 is the same as the voltage given by equation (1) described above.

On the other hand, a current control signal (PRICNT) output from a D/A port 5*f* of the MPU 5 is input to the positive input terminal of the operational amplifier 265. The current control signal (PRICNT) sets the drive voltage amplitude of the sine wave input to the high voltage transformer 204, i.e., the amplitude level of the AC output current (It). The current control signal (PRICNT) is an analog signal which changes in the range from 0 V to 5 V and corresponds to the digital value PRICNT. If the voltage (Vn) at the negative input terminal of the operational amplifier 265 is lower than the current control signal (PRICNT) voltage, the output from the operational amplifier 265 becomes large. Conversely, if the voltage (Vn) at the negative input terminal is higher than the current control signal (PRICNT) voltage, the output from the operational amplifier 265 becomes small.

As described above, when the output from the operational amplifier 265 is large, the amplitude of the clock pulse input to the filter circuit 235 becomes large, and the peak voltage of the AC high voltage becomes large. With this arrangement, the amplitude level of the AC high voltage (charge voltage) is controlled. As a result, control is done such that the AC output current (It) has a predetermined current value corresponding to the current control signal (PRICNT). That is, constant current control corresponding to the current control signal (PRICNT) is executed. The control value of the charge AC current has a characteristic given by $$I\text{mean}=\text{PRICNT}/Rs \tag{12}$$

A transistor 270 is also connected to the positive input terminal of the operational amplifier 265. The transistor 270 is driven by a signal (PRION) output from the I/O port 5*d* of the MPU 5. When the signal PRION is set to high level to turn on the transistor 270, the potential at the positive input terminal of the operational amplifier 265 can be changed to low level to turn off output of the charge AC voltage.

The voltage detection unit of the charge bias generation circuit will be described next. This charge bias generation circuit includes two voltage detection circuits, i.e., a voltage detection circuit A and a voltage detection circuit B.

(A) Voltage Detection Circuit A

The voltage detection circuit A detects the peak voltage value of the charge AC voltage.

Figure 14A:
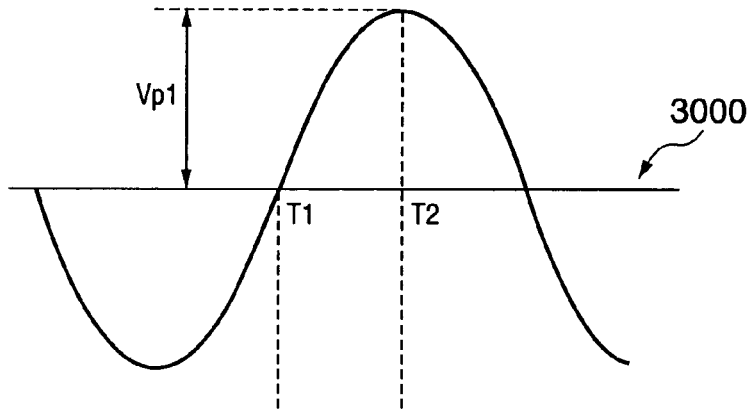
FIGS. 14A to 14C are graphs showing the relationship between a charge AC waveform according to the third embodiment of the present invention and a peak voltage value detected by a voltage detection circuit A.
Figure 14B:
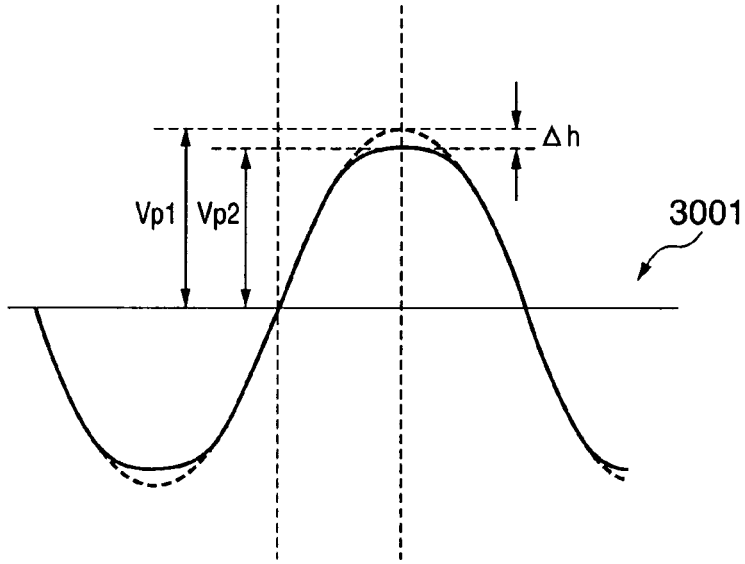
Figure 14C:
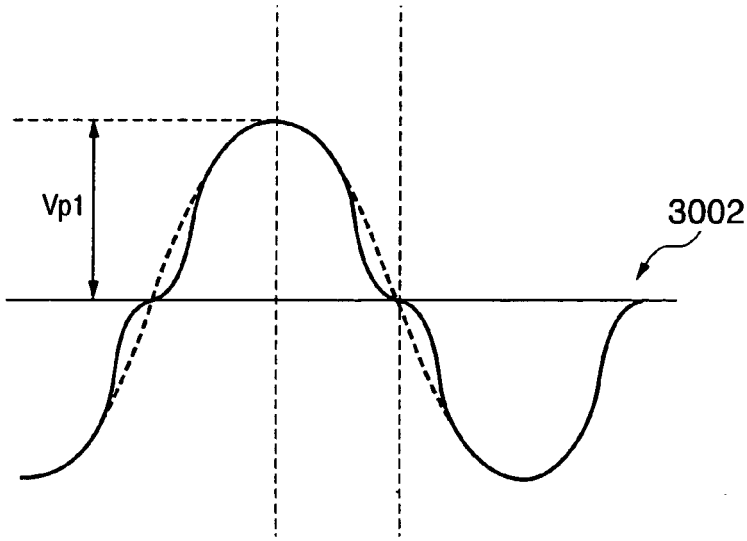

FIGS. 14A to 14C are graphs showing the relationship between the waveform of the charge AC voltage and a peak voltage value detected by the voltage detection circuit A. The abscissa represents time, and the ordinate represents a charge AC voltage Vp.

FIG. 14A depicts a case in which the waveform of the charge AC voltage is a sine wave. In this case, a voltage Vp1 is detected by the voltage detection circuit A. FIG. 14B depicts a waveform when the peak portion of the AC voltage waveform is distorted. The broken line indicates a waveform 3000 (FIG. 14A) as a sine wave. The peak portion is distorted, and the peak voltage is Vp2 lower than Vp1 by Δh. The voltage detection circuit A detects the voltage value Vp2.

The operation of the voltage detection circuit A will be described next.

The peak voltage is detected by detecting a current which flows to a capacitor 271 connected to a line at the equipotential with the charge voltage output terminal 299. An AC current corresponding to the level of the charge AC voltage flows to the capacitor 271. This current is shunted by diodes 276 and 289. The half-wave current in a direction of an arrow D flows to the diode 276. The half-wave current in a direction of an arrow C flows through the diode 289.

The half-wave current in the direction of the arrow D is input to an integrating circuit including an operation amplifier 281, resistors 282 and 283, and capacitor 288 and converted into a DC voltage. A peak voltage detection signal (PRIVS) corresponding to the converted DC voltage is input to an A/D port 5*e* of the MPU 5. The level of the peak voltage detection signal (PRIVS) is given by $$\text{PRIVS}=\text{C271}\times f\times\text{R283}\times 2\times Vp \tag{13}$$

where C271 is the electrostatic capacitance value of the capacitor 271, f is the frequency of the charge AC output, R283 is the resistance value of the resistor 283, and Vp is the peak voltage value (corresponding to Vp1 in FIGS. 14A to 14C) of the charge AC voltage.

(B) Voltage Detection Circuit B

The voltage detection circuit B detects the peak voltage value (corresponding to Vp2 in FIG. 14B) of the differential waveform of the charge AC voltage waveform.

A differential waveform is a waveform corresponding to the change in charge AC voltage waveform. The change in differential waveform is maximum or minimum when the AC voltage waveform indicates the voltage at the center of oscillation. Hence, when the AC voltage waveform indicates the peak voltage, the differential waveform does not change.

FIG. 14C shows the differential waveform of an AC voltage waveform 3001 (FIG. 14B). Referring to FIGS. 14A to 14C, at time T1 when the AC voltage waveform 3000 or 3001 indicates the voltage at the center of oscillation, a differential waveform 3002 indicates the peak voltage (Vp1). At time T2 when the AC voltage waveform 3000 or 3001 indicates the peak voltage (Vp1 or Vp2), the differential waveform 3002 indicates the at the center of oscillation without any change. The broken line indicates the waveform of the sine wave 3000. In a region near the peak where the waveform 3001 is distorted, the differential waveform 3002 is also distorted from the sine wave. In a region where the phase of the waveform 3001 has no distortion, the differential waveform 3002 coincides with the waveform of the sine wave. The peak value is Vp1 which is the same as the peak value of the waveform 3001. That is, the voltage detection circuit B detects and outputs the voltage Vp1 obtained by adding the distortion amount Ah to the peak voltage value (Vp2) of the charge AC voltage waveform having the distortion.

The operation of the voltage detection circuit B will be described next.

The charge output voltage is divided by the capacitor 271 and a resistor 273 and converted into a low voltage level. Since the diode 289 is connected between the capacitor 271 and the resistor 273, the half-wave AC waveform is input to the positive input terminal of an operational amplifier 286. The impedance of the capacitor 271 is set much higher than that of the resistor 273. That is, the half wave of the AC waveform obtained by dividing the differential waveform of the charge AC voltage is supplied to the positive input portion of the operational amplifier 286. The differential waveform is further converted into a DC voltage corresponding to the peak value of the AC waveform generated at the negative input terminal of an operational amplifier 280 by a peak voltage detection circuit including the operational amplifiers 286 and 280, diodes 272 and 279, capacitor 284, and resistors 285, 298, and 290, and input to the A/D port 5*e* of the MPU 5 as a differential voltage detection signal (PRIDVS). The level of the differential voltage detection signal (PRIDVS) is given by $$PRIDVS=C271\times f\times R273\times\pi\times 2\times Vd \quad (14)$$

where C271 is the electrostatic capacitance value of the capacitor 271, f is the frequency of the charge AC voltage output, R273 is the resistance value of the resistor 273, π is the circular constant, and Vd is the peak voltage of the differential value of the charge AC voltage.

As is apparent from equations (13) and (14), the peak voltage detection signal (PRIVS) and differential voltage detection signal (PRIDVS) are proportional to the electrostatic capacitance value of the capacitor 271. That is, even when the electrostatic capacitance value of the capacitor 271 varies due to environmental conditions, the relative value between the two signals is constant.

A discharge current detection method according to the third embodiment will be described next. As a characteristic feature of the image forming apparatus according to the third embodiment, the peak value of the charge AC voltage and the peak value of the differential value of the charge AC voltage are detected, and the discharge current value is calculated on the basis of the detected peak values.

Figure 15A:
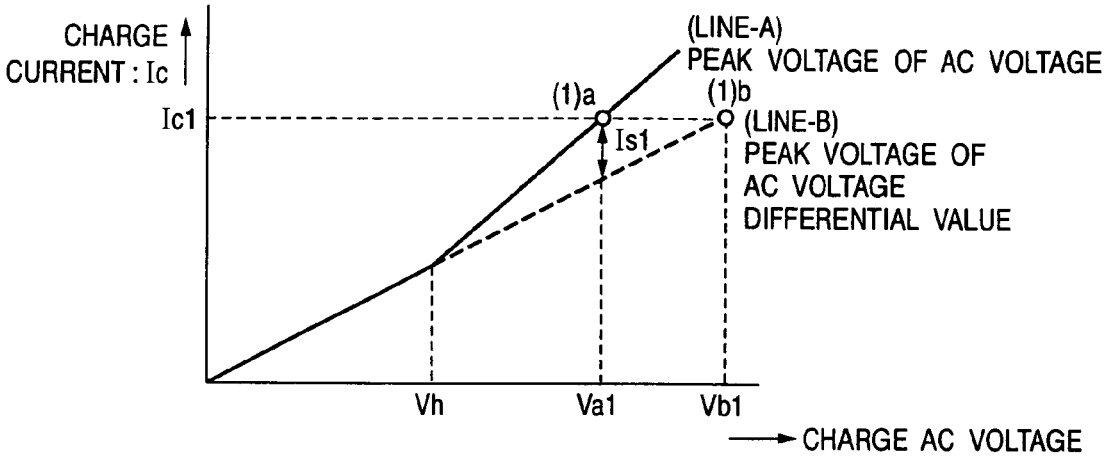
FIG. 15A depicts a graph showing the relationship between a charge AC current value (Ic) and the peak value of a charge AC current applied to the charge roller and the differential peak value of the charge AC voltage.

FIG. 15A is a graph showing the peak value of the charge AC current applied to the charge roller 2 and the relationship between a charge AC current value (Ic) and the differential peak value of the charge AC voltage.

When the charge AC voltage is applied to the charge roller 2, the charge current (Ic) flows. In a region (non-discharge generation region) where the charge AC voltage is equal to or lower than a discharge start voltage (Vth), the charge AC current linearly (proportionally) increases in proportion to the increase in charge AC voltage. In the non-discharge generation region, only a nip current corresponding to the resistive load and capacitive load between the charge roller 2 and a photosensitive drum 1 flows.

In a region (discharge generation region) where the charge AC voltage rises and exceeds the discharge start voltage (Vth), discharge occurs between the charge roller 2 and the photosensitive drum 1 and the charge current (Ic) obtained by adding the discharge current to the above-described nip current flows. In the above-described non-discharge generation region, the charge AC voltage peak value and the charge AC voltage differential peak value are in proportion to each other. In the discharge generation region, the peak value of the charge AC voltage becomes a value along a line LINE-A in FIG. 15A, and the peak value of the charge AC voltage difference becomes a value along a line LINE-B in FIG. 15A. That is, the two characteristics have a difference.

The reason why the characteristics have a difference, as indicated by the two characteristic lines LINE-A and LINE-B, will be described with reference to FIG. 16.

Figure 16:
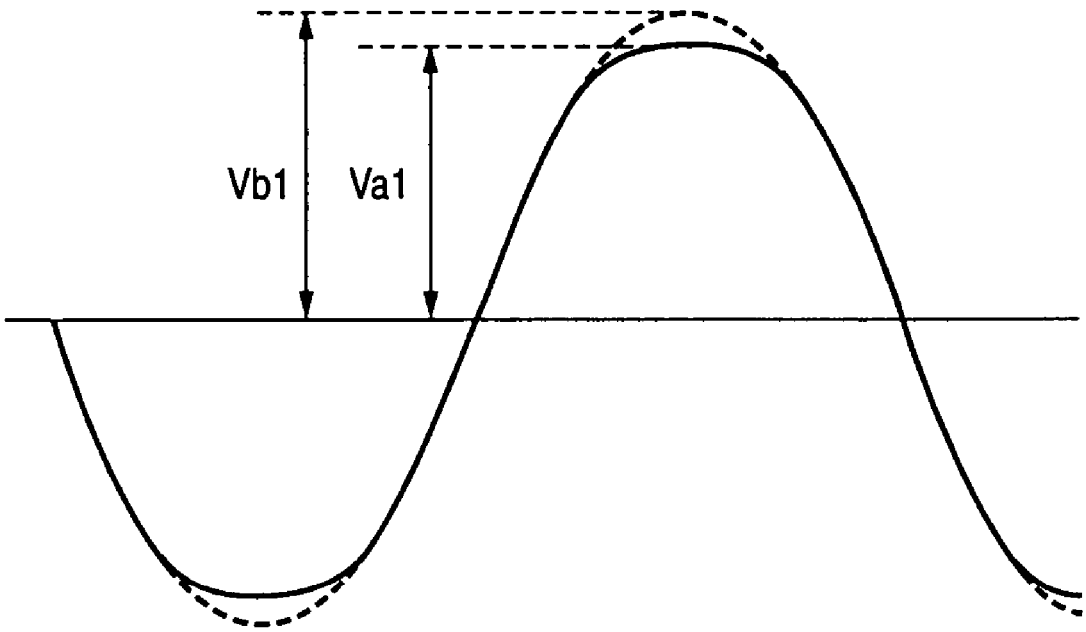
FIG. 16 depicts a graph showing a charge AC voltage waveform when the charge AC voltage is set to Val higher than the discharge start voltage (Vth)

FIG. 16 is a graph showing the charge AC voltage waveform when the charge AC voltage is set to a voltage Val which is higher than the discharge start voltage (Vth). The waveform is distorted near the peak of the AC waveform.

This waveform distortion occurs because the output from the high voltage transformer 204 is distorted by discharge. When the charge AC voltage exceeds a discharge start voltage (Vh), discharge occurs at a timing near the peak of the AC voltage, and a discharge current flows. This discharge current instantaneously flows with a steep leading edge. For this reason, when the discharge current flows to the high voltage transformer 204 which generates the charge AC voltage, a voltage drop occurs between the output terminals of the high voltage transformer 204 due to the function of the leakage inductance of the high voltage transformer 204, and the waveform of the output voltage is distorted. At this time, the peak value of the charge AC voltage is Va1. On the other hand, the peak value of the differential value of the charge AC voltage is a voltage Vb1 obtained by adding the distortion amount to the voltage Va1. As a result, the characteristic lines LINE-A and LINE-B indicate different characteristics.

As shown in FIG. 15A, the line LINE-A indicates a discontinuous characteristic from the discharge start voltage (Vh). To the contrary the line LINE-B indicates a characteristic which linearly changes with respect to the peak value of the differential value of the charge AC voltage. This is because the output power of the high voltage transformer 204 constantly operates independently of the presence/absence of discharge because of the operation characteristic of the high voltage transformer 204.

The discharge current value can be calculated from the relationship indicated by the lines LINE-A and LINE-B. Let (Vp) be the peak value of the charge AC Voltage, (Vd) be the differential peak value of the charge AC voltage, and (Ic) be the charge current. A discharge current value (Is) is given by $$Is=Ic\times(Vd-Vp)/Vd \quad (15)$$

From equations (15), (13), and (14), the discharge current can be calculated by $$Is=Ic\times(1-\pi\times R273/R283\times PRIVS/PRIDVS) \quad (16)$$

In the image forming apparatus according to the third embodiment, the charge AC voltage peak value (Vp) is detected by the voltage detection circuit A. The charge AC voltage differential peak value (Vd) is detected by the voltage detection circuit B. The charge current (Ic) is set to the constant current control circuit including the operational amplifier 265, diodes 249 and 250, and capacitors 248 and 254 in accordance with PRICNT, thereby calculating the discharge current value.

Figure 15B:
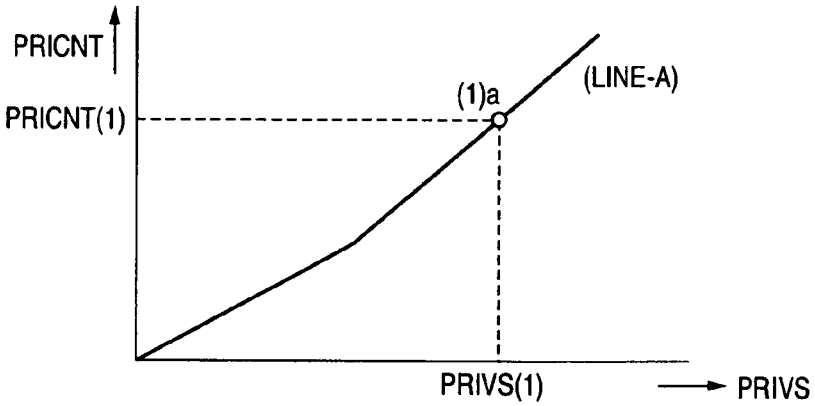
FIGS. 15B and 15C depict graphs showing the detection characteristics of a signal PRIVS and a signal PRIDVS in correspondence with FIG. 15A.
Figure 15C:
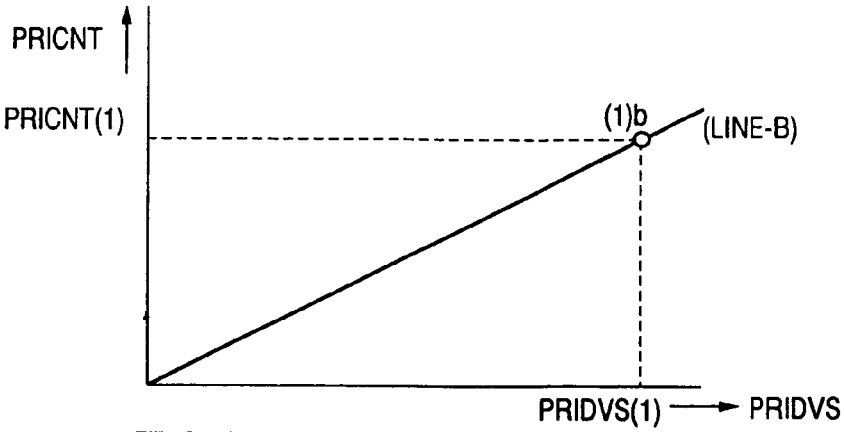

FIGS. 15B and 15C are graphs showing the PRIVS and PRIDVS detection characteristics in correspondence with FIG. 15A.

When the charge AC current (Ic) is Ic1, the charge AC voltage peak value is Va1 in FIG. 15A, and the signal PRIVS is PRIVS(1) (FIG. 15B). The charge AC voltage differential peak value is Vb1 in FIG. 15A, and the signal PRIDVS at this time is PRIDVS(1) (FIG. 15C). The discharge current (Is) can be calculated by the MPU 5 by using equation (16) on the basis of the levels of the detected signals PRIVS and PRIDVS. As is apparent from equation (16), the calculation value of the discharge current (Is) and the capacitance value of the capacitor 271 are irrelevant. That is, in discharge current calculation according to the third embodiment, discharge current Is can accurately be calculated even when the characteristic of the capacitor 271 changes due to, e.g., a change in temperature.

The series of charge high voltage control processing procedures in the print operation of the image forming apparatus according to the third embodiment will be described next.

Figure 17:
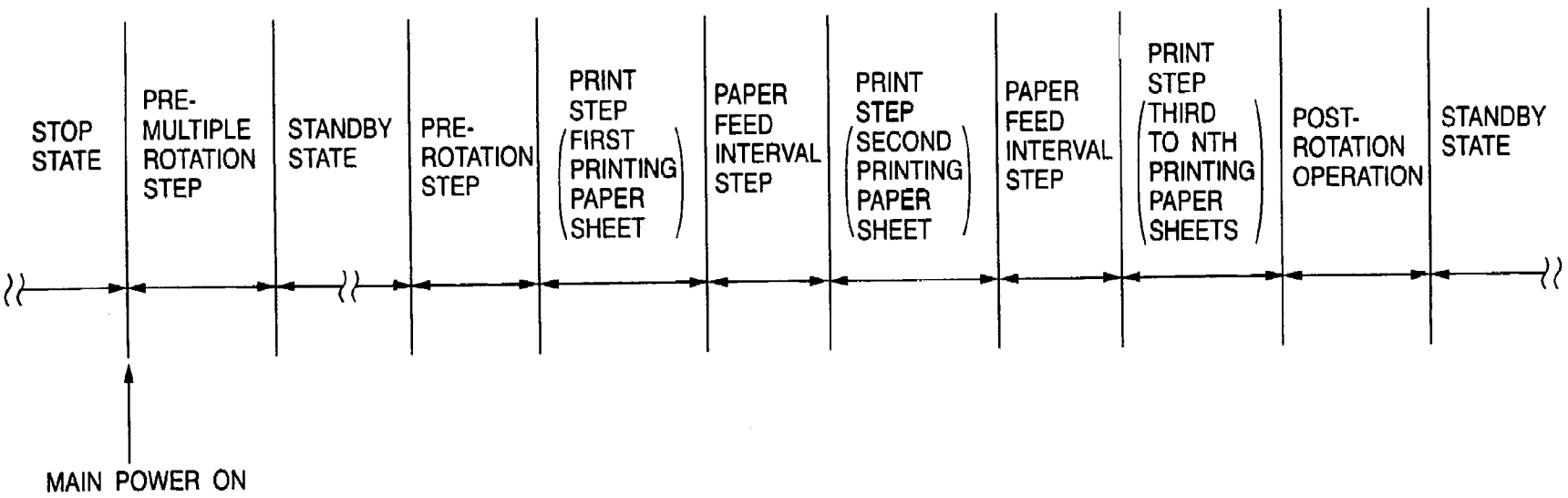
FIG. 17 depicts a view showing the sequence of the print operation of an image forming apparatus according to the third embodiment.

FIG. 17 depicts a view showing the sequence of the print operation of the image forming apparatus according to the third embodiment. When the main power of the laser beam printer 100 is turned on, a pre-multiple rotation step is executed to perform a series of processing operations of, e.g., driving the fixing unit and heating a heater 116 of a fixing roller 117 to a predetermined temperature. Then, a standby state is set. When a print start instruction is received from an external device 128 such as a personal computer, a pre-rotation step as predetermined print preparation is executed. After that, a print step of executing printing on a printing paper sheet by a series of electrophotographic processes starts. In a mode for executing the print operation on a plurality of printing paper sheets, predetermined processing is executed in a paper feed interval step until the print operation for the next printing paper sheet. Then, the print step for the second and subsequent paper sheets starts. When the print step for the last printing paper sheet is ended, a post-rotation step is executed, and the standby state is set again.

In the image forming apparatus according to the third embodiment, processing for determining the charge AC voltage level is continuously executed in the pre-rotation step, print step, and paper feed interval step, and the charge AC voltage level is controlled in real time on the basis of the result.

Figure 18:
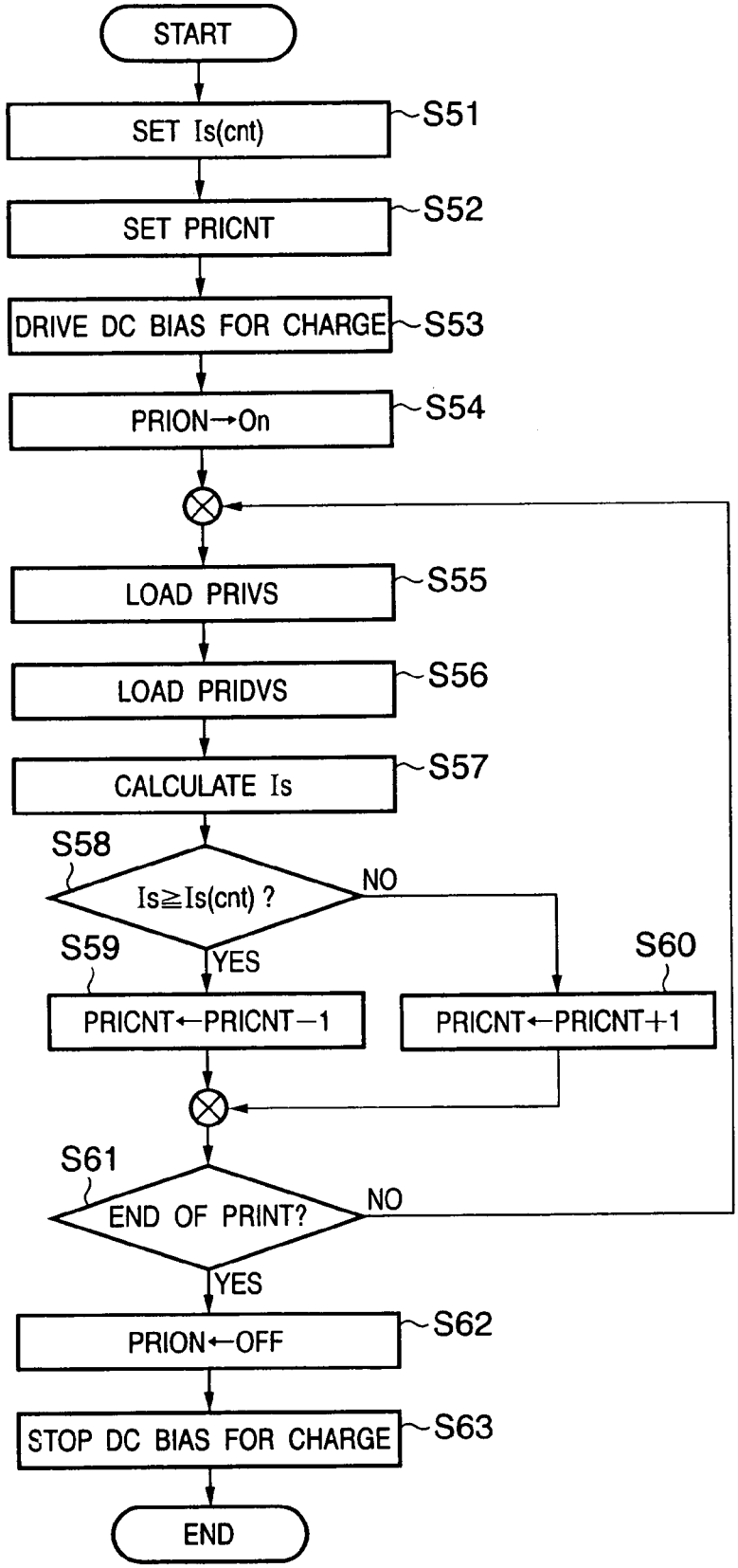
FIG. 18 is a flowchart showing a high charge voltage control sequence in the laser beam printer according to the third embodiment.

FIG. 18 is a flowchart for explaining the series of charge high voltage control processes in the print operation of the image forming apparatus according to the third embodiment. The program which executes the processing is stored in a ROM 5*b* and is executed under the control of the MPU 5.

When the print operation starts, first, a discharge current control value (Is(cnt)) is set in step S51. The control value (Is(cnt)) is set by using a value stored in the ROM 5*b* of the main body. The flow advances to step S52 to set PRICNT to set the initial value of the constant current control level of the charge current, thereby setting the output voltage of the D/A port 5*f*. This set value is stored in the ROM 5*b* arranged in the image forming apparatus. The flow advances to step S53 to drive the charge DC bias at a predetermined timing during pre-rotation. In step S54, the charge AC bias driving signal (PRION) is switched to low level. Accordingly, the transistor 270 is turned off, and the charge AC bias is output from the operational amplifier 265. Subsequently, in steps S55 to S57, the discharge current is measured.

First, in step S55, the detection value (PRIVS) by the voltage detection circuit A is acquired. In step S56, the detection value (PRIDVS) by the voltage detection circuit B is acquired. In step S57, the discharge current value (Is) is calculated by using equation (16) described above on the basis of the values PRIVS and PRIDVS loaded in steps S55 and 56.

The flow advances to step S58 to compare the discharge current value (Is) calculated in step S57 with the set value (Is(cnt)) set in step S51. If the discharge current value (Is) is larger than the set value (Is(cnt)), the flow advances to step S59. The signal PRICNT which sets the constant current control level of the charge current is decreased by a predetermined amount ("1" in this case), and a corresponding voltage is output from the D/A port 5*f*. Accordingly, control is done to decrease the level of the charge AC voltage.

If it is determined in step S58 that the discharge current value (Is) is smaller than the control value (Is(cnt)), the flow advances to step S60. The signal PRICNT which sets the constant current control level of the charge current is increased by a predetermined amount ("1" in this case), and a corresponding voltage is output from the D/A port 5*f*. Accordingly, control is done to increase the level of the charge AC output. In step S61, it is determined whether printing is ended. If printing is to be continued, the flow returns to step S55 to repeat the processing. With this repetitive processing, the output of the charge AC voltage is controlled such that the discharge current value (Is) reaches the desired level (Is(cnt)).

If YES in step S61, the flow advances to step S62 to switch the charge AC bias driving signal (PRION) to high level to turn on the transistor 270 to stop the charge AC bias. In step S63, the charge DC bias is stopped, thus ending the series of processing operations. The series of processing operations are continuously executed in the pre-rotation step, print step, and paper feed interval step. Hence, the charge AC high voltage level is controlled in real time such that the discharge current value always has a desired value.

As described above, according to charge voltage control of the third embodiment, one capacitor is arranged in the charge voltage output unit. The charge AC voltage peak value is detected by measuring a current which flows to the capacitor. The charge AC voltage differential peak value is detected by measuring a voltage generated in a resistor which is connected in series with the capacitor. The discharge current is calculated from the detected charge AC voltage peak value and charge AC voltage differential peak value. The charge AC level is controlled such that the discharge current has a desired value.

With this arrangement, the discharge current can be detected in the discharge generation region, and the discharge current value can always optimally be controlled in the pre-rotation step, print step, and paper feed interval step. Accordingly, uniform charge can be obtained independently of environmental variations or characteristic variations of the charge member in the manufacture without causing any degradation in photosensitive drum or abnormal images.

Even when the capacitance of the capacitor varies due to a change in environment, the relative relationship between the peak value of the charge AC voltage and the differential peak value of the charge AC voltage does not change. Hence, even when environmental variations occur, accurate discharge current control can be implemented, and stable charge control can be executed.

[Fourth Embodiment]

The fourth embodiment of the present invention will be described next. The basic arrangement of an image forming apparatus according to the fourth embodiment is the same as that of the above-described third embodiment except in the arrangements of voltage detection circuits A and B in the charge output circuit.

Figure 19:
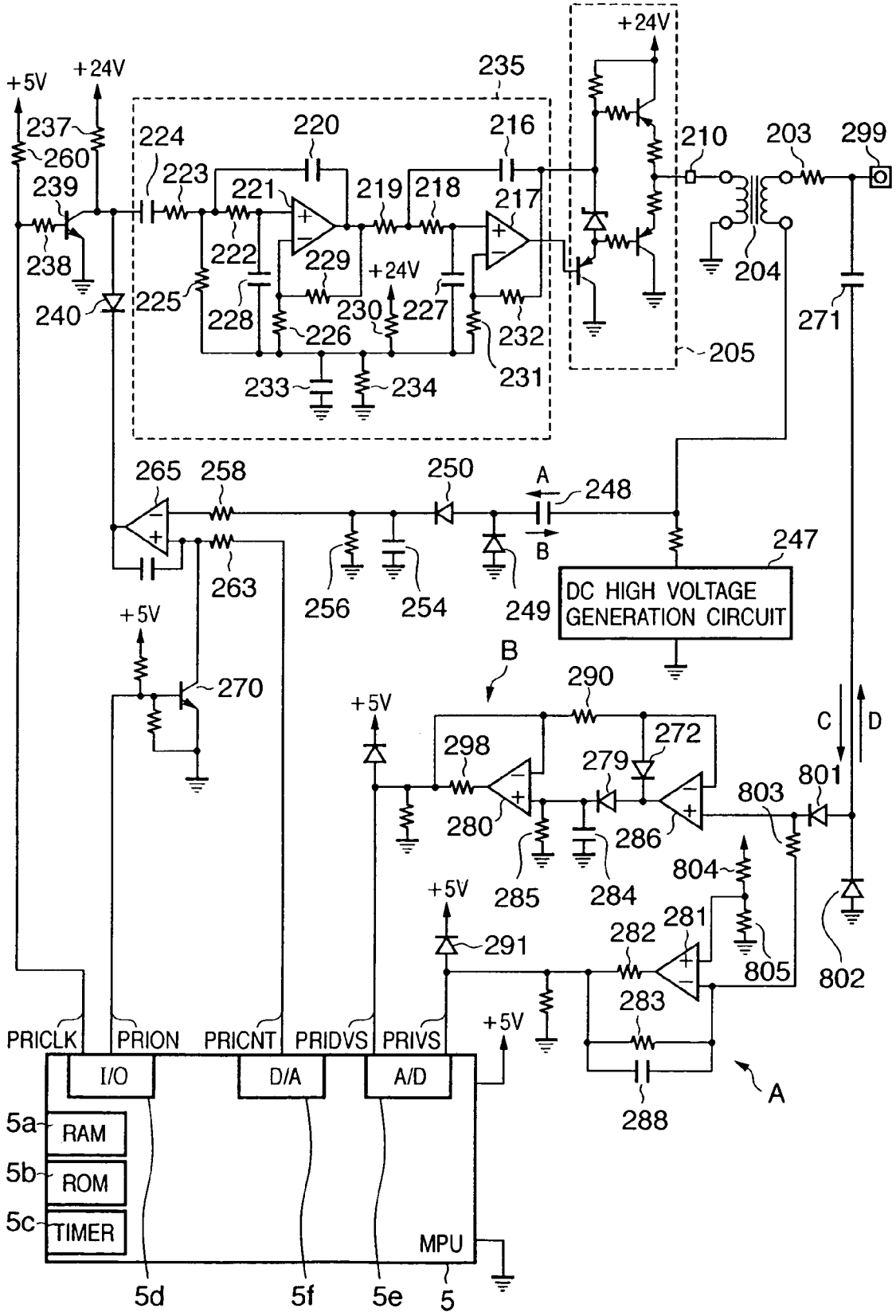
FIG. 19 is a block diagram showing the arrangement of a charge voltage control circuit according to the fourth embodiment of the present invention.

FIG. 19 is a block diagram showing the arrangement of a charge control circuit according to the fourth embodiment of the present invention. The same reference numerals as in FIG. 13 according to the above-described third embodiment denote the same parts in FIG. 19, and a description thereof will be omitted.

(A) Voltage Detection Circuit A

The voltage detection circuit A detects the peak voltage value of the charge AC voltage, as in the third embodiment.

The peak voltage is detected by detecting a current which flows to a capacitor 271 connected to a line at the equipotential with a charge voltage output terminal 299. An AC current corresponding to the level of the charge AC voltage flows to the capacitor 271 and is shunted by diodes 801 and 802. The half-wave current in a direction of an arrow D flows to the diode 802. The half-wave current in a direction of an arrow C flows through the diode 801. The half-wave current in the direction of the arrow C is input to an integrating circuit including an operation amplifier 281, resistors 282 and 283, and capacitor 288 and converted into a DC voltage. The voltage-converted signal is input to an A/D port 5*e* of an MPU 5 as a peak voltage detection signal (PRIVS).

The level of the peak voltage detection signal is given by $$\text{PRIVS}=Vt2-C271\times f\times R283\times 2\times Vp \quad (17)$$

where C271 is the electrostatic capacitance value of the capacitor 271, f is the frequency of the charge AC output, R283 is the resistance value of the resistor 283, Vp is the peak voltage value of the charge AC voltage, and Vt2 is the voltage of the positive input terminal of the operation amplifier 281. The voltage Vt2 is set to a value obtained by dividing a 5-V power supply voltage by resistors 804 and 805.

(B) Voltage Detection Circuit B

The voltage detection circuit B detects the peak voltage value of the differential waveform of the charge AC voltage waveform, as in the above-described third embodiment.

The charge output voltage is divided by the capacitor 271 and a resistor 803. One terminal of the resistor 803 is connected to the negative input terminal of the operation amplifier 281. The positive input terminal of the operation amplifier 281 is held at the above-described voltage Vt2. For this reason, a voltage obtained by adding the DC voltage (Vt2) to the AC waveform of the divided half wave is applied to the positive input terminal of an operational amplifier 286. The impedance of the capacitor 271 is set much higher than that of the resistor 803. A voltage obtained by adding the half wave of the AC waveform corresponding to the differential value of the charge AC voltage to the DC voltage level (Vt2) is supplied to the positive input terminal of the operational amplifier 286. The differential waveform is further converted into a DC voltage corresponding to the peak value of the differential AC waveform by a peak voltage detection circuit including the operational amplifiers 286 and 280, diodes 272 and 279, capacitor 284, and resistors 285, 298, and 290, and input to the A/D port 5*e* of the MPU 5 as a differential voltage detection signal (PRIDVS). The level of the differential voltage detection signal (PRIDVS) is given by $$\text{PRIDVS}=C271\times f\times R803\times \pi\times 2\times Vd\times Vt2 \quad (18)$$

where C271 is the electrostatic capacitance value of the capacitor 271, f is the frequency of the charge AC output, R803 is the resistance value of the resistor 803, π is the circular constant, and Vd is the peak voltage of the differential value of the charge AC voltage.

Figure 20A:
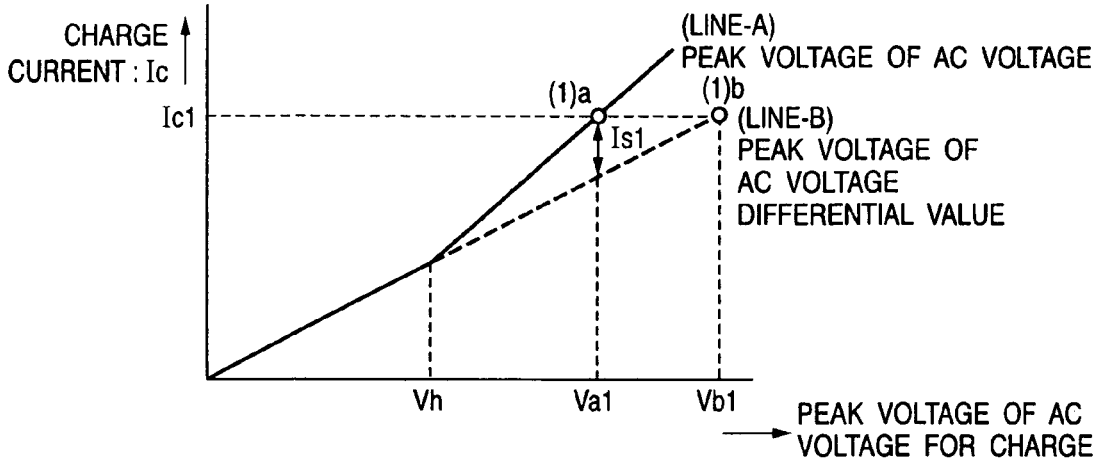
FIG. 20A depicts a graph showing the characteristics of the peak value of a charge AC current applied to the charge roller, the charge AC voltage differential peak value, and a charge AC current value (Ic)

FIG. 20A is a graph for explaining the relationship between a charge AC current value (Ic) and the peak value of the charge AC current applied to a charge roller 2 and the charge AC voltage differential peak value.

Figure 20B:
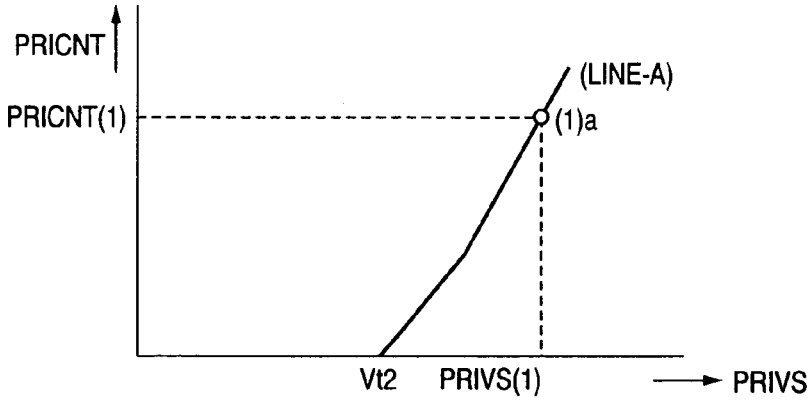
FIGS. 20B and 20C depict graphs showing the detection characteristics of a signal PRIVS and a signal PRIDVS in correspondence with FIG. 20A.
Figure 20C:
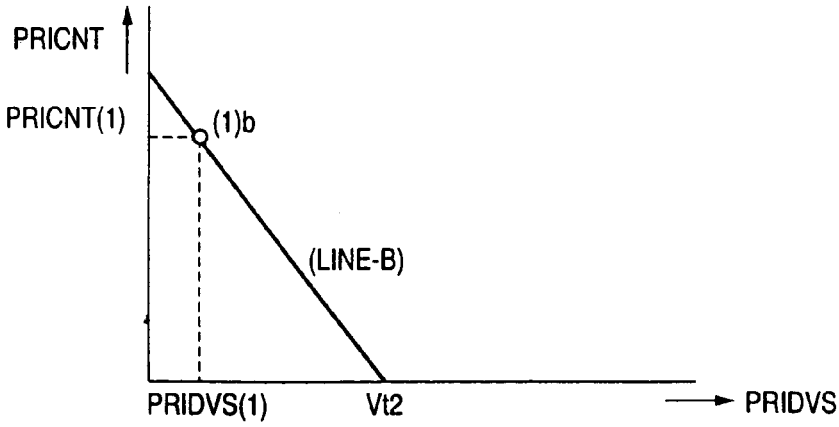
Figure 21:
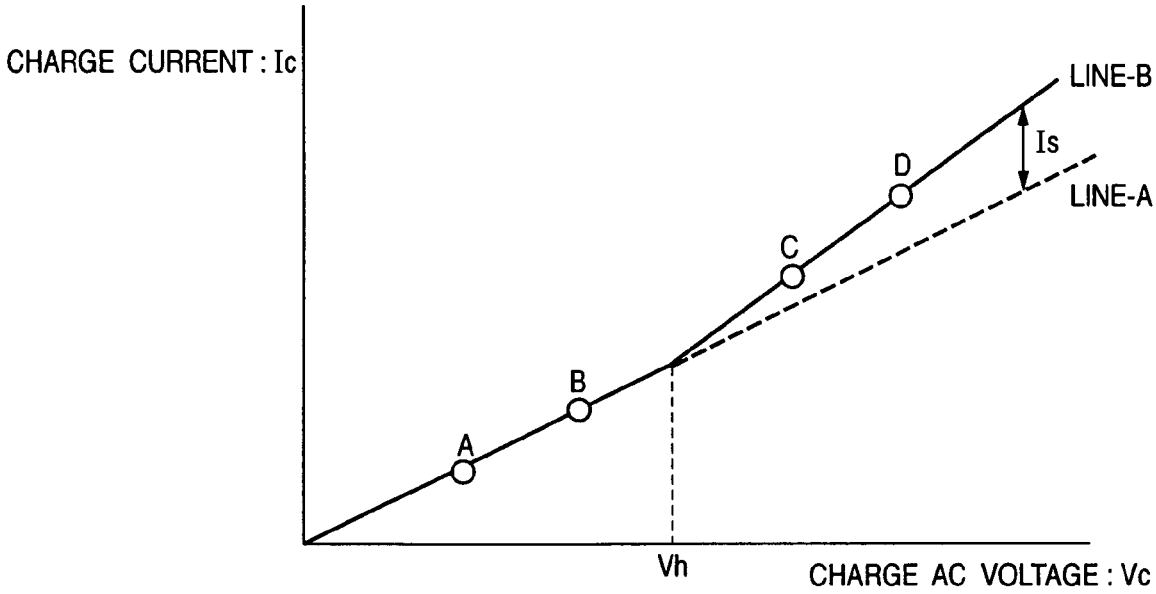
FIG. 21 depicts a graph for explaining conventional discharge control.
Figure 22:
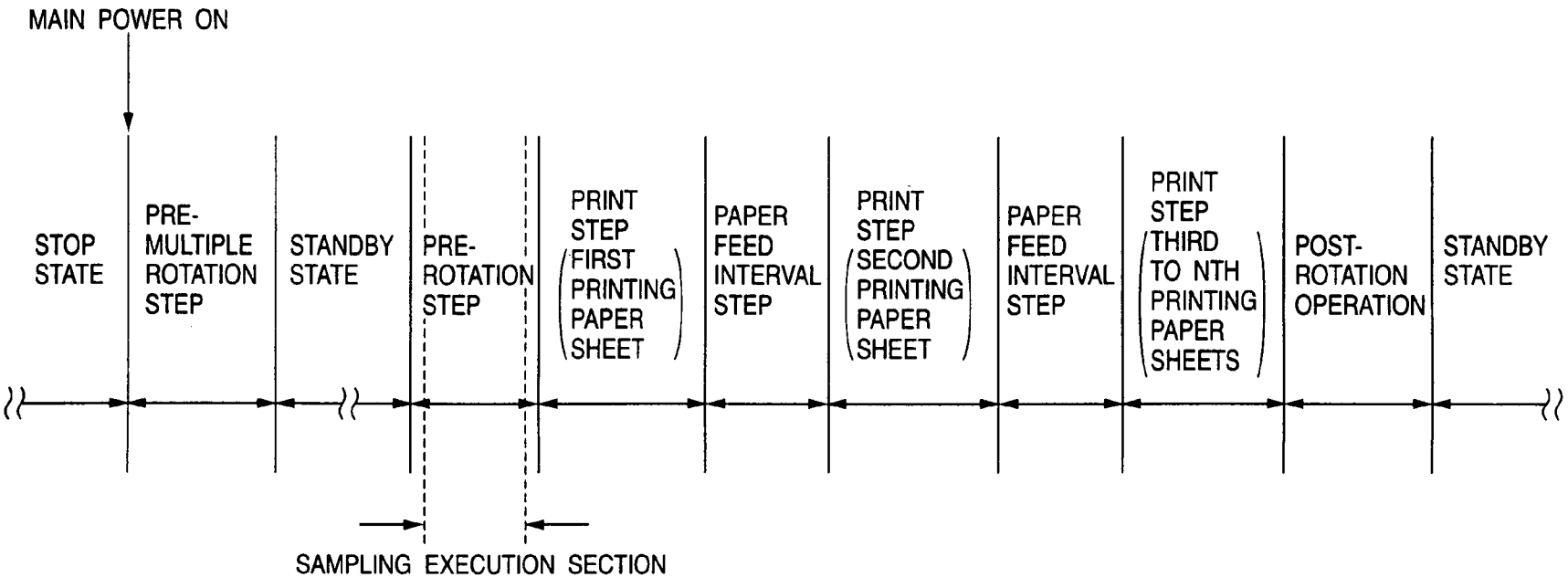
FIG. 22 depicts a view showing the timing of sampling in an image forming apparatus using the conventional discharge current control method.

FIGS. 20B and 20C are graphs showing the detection characteristics of the signals PRIVS and PRIDVS in correspondence with FIG. 20A. When the charge AC current (Ic) is Icl, the peak value of the charge AC voltage is Val, and the signal PRIVS is PRIVS(1). On the basis of the levels of the detected signals PRIVS and PRIDVS, the MPU 5 calculates a discharge current (I) by using $$I=I\times(1-\pi\times(Vt2-\text{PRIVS})/(\text{PRIDVS}-Vt2)\times R803/R283) \quad (19)$$

The series of charge high voltage control processes in the print operation of the image forming apparatus according to the fourth embodiment are the same as in the above-described third embodiment. Only discharge current calculation is executed in accordance with the above-described procedures.

With this control, the same effect as in the third embodiment can be obtained.

As described above, according to high charge voltage control of the fourth embodiment, one capacitor is arranged in the charge voltage output unit. The charge AC voltage peak value is detected by measuring a current which flows to the capacitor. The charge AC voltage differential peak value is detected by measuring a voltage generated in a resistor which is connected in series with the capacitor. The discharge current is calculated from the detected charge AC voltage peak value and charge AC voltage differential peak value. The charge AC level is controlled such that the discharge current has a desired value.

With this arrangement, the discharge current can be detected in the discharge generation region, and the discharge current value can always optimally be controlled in the pre-rotation step, print step, and paper feed interval step. Accordingly, uniform charge can be obtained independently of environmental variations or characteristic variations of the charge member in the manufacture without causing any degradation in photosensitive drum or abnormal images.

Even when the capacitance of the capacitor varies due to a change in environment, the relative relationship between the peak value of the charge AC voltage and the differential peak value of the charge AC voltage does not change. Hence, even when environmental variations occur, accurate discharge current control can be implemented, and stable charge control can be executed.

[Other Embodiment]

The objects of the present invention can be achieved by supplying a software program which implements the functions of the above-described embodiments to the a computer or CPU and causing the computer or CPU to read out and execute the supplied program.

In this case, the program can be either supplied directly from a storage medium on which the program is recorded or downloaded from another computer (not shown) or database connected to the Internet, commercial network, or local area network.

The program can take any form such as an object code, a program code to be executed by an interpreter, or script data to be supplied to the OS (Operating System).

The present invention can also be achieved by supplying a storage medium which stores a software program for implementing the functions of the above-described embodiments to a computer or CPU and causing the computer or CPU to read out and execute the program stored in the storage medium.

In this case, the program codes read out from the storage medium implement the functions of the above-described embodiments by themselves, and the storage medium which stores the program codes constitutes the present invention.

As the storage medium to store the program codes, for example, a ROM, RAM, NV-RAM, floppy (registered trademark) disk, hard disk, optical disk (registered trademark), magnetooptical disk, CD-ROM, MO, CD-R, CD-RW, DVD-ROM, DVD-RAM, DVD-RW, DVD+RW, magnetic tape, nonvolatile memory card, or the like can be used.

The functions of the above-described embodiments can also be implemented not only when the readout program codes are executed by the computer but also when the OS running on the computer performs part or all of actual processing on the basis of the instructions of the program codes.

The present invention is not limited to the above embodiments and various changes and modifications can be made thereto within the spirit and scope of the present invention. Therefore, to apprise the public of the scope of the present invention, the following claims are made.

CLAIM OF PRIORITY

This patent application claims priority from Japanese Patent Applications No. 2003-390753 and 2003-390754 filed on Nov. 20, 2003, which are hereby incorporated by references herein.

What is claimed is:

1. An image forming apparatus which charges an image carrier and transfers an image formed on the image carrier to a recording medium to form an image, comprising:

AC voltage generation means for generating an AC voltage;

a charge member to which the AC voltage from said AC voltage generation means is applied;

current detection means, connected through a capacitive member to a path which supplies a current from said AC voltage generation means to said charge member, for detecting a current value corresponding to the AC voltage flowing to the capacitive member; and control means for determining an AC voltage upon image formation on the basis of a first value which is detected by said current detection means when an AC voltage less than a discharge start voltage in the image carrier is applied to the charge member and a second value which is detected by said current detection means when an AC voltage not less than the discharge start voltage is applied to the charge members, wherein said control means calculates a discharge current on the basis of the first and second values after start of image forming and controls the AC voltage so that the calculated discharge current becomes a predetermined value upon image forming on the recording medium.

2. The apparatus according to claim 1, wherein the AC voltage is a voltage obtained by superposing a DC voltage on an AC voltage.

3. The apparatus according to claim 1, wherein said current detection means converts the current value flowing to the capacitive member into a voltage signal and supplies the voltage signal to said control means, and said control means determines the AC voltage on the basis of the voltage signal.

4. The apparatus according to claim 1, wherein said control means controls said AC voltage generation means to ensure a predetermined relationship between the second value detected by said current detection means and a current value flowing to the charge member upon detecting the second value.

5. The apparatus according to claim 1, wherein said control means obtains a discharge current value based on the second value and a current value flowing to the charge member when the AC voltage whose peak voltage is not less than the discharge start voltage is applied to the charge member, and determines the AC voltage so as to make the discharge current value equal to a predetermined value.

6. The apparatus according to claim 1, wherein said control means determines the AC voltage upon image formation on the basis of the first value, the second value, and a third value which is detected by said current detection means when an AC voltage being less than the discharge start voltage in the image carrier and different from the AC voltage is applied to the charge member.

7. The apparatus according to claim 6, wherein said control means determines the AC voltage upon image formation on the basis of the first value, the second value, the current value, and a fourth current value which is detected by said current detection means when an AC voltage being not less than the discharge start voltage in the image carrier and different from the AC voltage is applied to the charge member.

8. An image forming apparatus for charging an image carrier and transferring an image formed on the image carrier to a printing medium to form an image, comprising:

AC voltage generation means for generating an AC voltage;

a charge member to which the AC voltage from said AC voltage generation means is applied;

first output means, connected through a capacitive member to a path which supplies a current from said AC voltage generation means to said charge member, for outputting information corresponding to a peak voltage of the AC voltage applied to said charge member;

second output means, connected to the path through the capacitive member, for outputting information corresponding to a change in AC voltage applied to said charge member; and control means for determining an AC voltage upon image formation on the basis of output results from said first output means and said second output means when said AC voltage generation means outputs the AC voltage whose peak voltage is not less than a discharge start voltage in the image carrier.

9. The apparatus according to claim 8, wherein the information corresponding to the change in AC voltage is information corresponding to a difference between a maximum value and a minimum value of a change ratio of the AC voltage.

10. The apparatus according to claim 9, wherein said first output means and said second output means output identical values when said AC voltage generation means generates the AC voltage whose peak-to-peak voltage is not more than the discharge start voltage in the image carrier.

11. The apparatus according to claim 8, wherein said first output means outputs the information corresponding to the peak voltage of the AC voltage by detecting an AC current which flows to the capacitive member.

12. The apparatus according to claim 11, wherein said first output means outputs the information corresponding to the peak voltage of the AC voltage by detecting an average value of half-wave currents of the AC current which flows to the capacitive member.

13. The apparatus according to claim 9, wherein said second output means outputs the information corresponding to the difference between the maximum value and the minimum value of the change ratio of the AC voltage on the basis of a peak value of a half-wave current of an AC current which flows to the capacitive member.

14. A charge voltage control circuit for controlling a charge voltage to be supplied to a charge member to charge an image carrier, comprising:

a voltage generation circuit configured to generate a primary AC voltage to be input to a primary side of a voltage transformer;

a control circuit configured to control the primary AC voltage generated by said voltage generation circuit so as to make a current generated on a secondary side of the voltage transformer in accordance with the primary AC voltage a predetermined value; and a current detection circuit connected, through a capacitive member, to a path for supplying the current generated on the secondary side of the voltage transformer to the charge member and configured to detect a current value corresponding to a secondary AC voltage applied to the capacitive member, wherein said control circuit determines a primary AC voltage upon charging the image carrier on the basis of a first current value which is detected by said current detection circuit when the primary AC voltage in which a peak voltage of the secondary AC voltage becomes less than a discharge start voltage in the image carrier is applied and a second current value which is detected by said current detection circuit when the primary AC voltage in which the peak voltage of the secondary AC voltage becomes not less than the discharge start voltage is applied.

15. The circuit according to claim 14, wherein the secondary AC voltage is a voltage obtained by superposing a DC voltage on an AC voltage.

16. The circuit according to claim 14, wherein said current detection circuit converts the current value flowing to the capacitive member into a voltage signal and supplies the voltage signal to said control circuit.

17. The circuit according to claim 14, wherein said control circuit controls said voltage generation circuit to ensure a predetermined relationship between the second current value detected by said current detection circuit and an output current from said voltage generation circuit upon detecting the second current value.

18. The circuit according to claim 14, wherein said control circuit obtains a discharge current value based on the second current value which is detected by said current detection circuit and an output current from said voltage generation circuit when the AC voltage in which the peak voltage of the secondary AC voltage is not less than the discharge start voltage is applied, and determines the primary AC voltage so as to make the discharge current value equal to a predetermined value.

19. The circuit according to claim 14, wherein said control circuit determines the primary AC voltage in charging the image carrier on the basis of the first current value, the second current value, and a third current value which is detected by said current detection circuit when a primary AC voltage which is different from the primary AC voltage and makes the peak voltage of the secondary AC voltage less than the discharge start voltage in the image carrier is applied.

20. The circuit according to claim 19, wherein said control circuit determines the primary AC voltage upon image forming on the basis of the first current value, the second current value, the third current value, and a fourth current value which is detected by said current detection circuit when a primary AC voltage which is different from the primary AC voltage and makes the peak voltage of the secondary AC voltage not less than the discharge start voltage in the image carrier is applied.

21. A charge voltage control circuit for controlling a charge voltage to be supplied to a charge member to charge an image carrier, comprising:

a voltage generation circuit configured to generate a primary AC voltage to be input to a primary side of a voltage transformer;

a control circuit configured to control the primary AC voltage generated by said voltage generation circuit so as to make a current generated on a secondary side of the voltage transformer in accordance with the primary AC voltage a predetermined value;

a first output circuit connected, through a capacitive member, to a path which supplies the current generated on the secondary side of the voltage transformer to the charge member, configured to output information corresponding to a peak voltage of the secondary AC voltage applied to the charge member; and a second output circuit connected to the path through the capacitive member, configured to output information corresponding to a differential value of the secondary AC voltage applied to the charge member, wherein said control circuit determines a primary AC voltage in image formation on the basis of output results from said first output circuit and said second output circuit when said voltage generation circuit generates the secondary AC voltage whose peak voltage is not less than a discharge start voltage in the image carrier.

22. The circuit according to claim 21, wherein the information corresponding to the differential value of the secondary AC voltage is information corresponding to a difference between a maximum value and a minimum value of a change ratio of the secondary AC voltage.

23. The circuit according to claim 21, wherein said first output circuit and said second output circuit output identical signals when said voltage generation circuit generates the secondary AC voltage whose peak-to-peak voltage is not more than the discharge start voltage in the image carrier.

24. The circuit according to claim 23, wherein said first output circuit outputs the information corresponding to the peak voltage of the secondary AC voltage by detecting a secondary AC current which flows to the capacitive member.

25. The circuit according to claim 21, wherein said second output circuit outputs the information corresponding to the differential value of the secondary AC voltage by detecting a peak value of a secondary AC current which flows to the capacitive member.

* * * * *

UNITED STATES PATENT AND TRADEMARK OFFICE

CERTIFICATE OF CORRECTION

PATENT NO. : 7,139,501 B2
APPLICATION NO. : 10/985931
DATED : November 21, 2006
INVENTOR(S) : Hiroshi Takami et al.

It is certified that error appears in the above-identified patent and that said Letters Patent is hereby corrected as shown below:

COLUMN 20:
Line 60, "Ah" should read --Δh--.

COLUMN 23:
Line 10, "When" should begin a new paragraph.

COLUMN 27:
Line 43, "members," should read --member,--.

Signed and Sealed this

Twenty-fifth Day of March, 2008

JON W. DUDAS
*Director of the United States Patent and Trademark Office*